US011076688B2

(12) United States Patent
Ergun et al.

(10) Patent No.: US 11,076,688 B2
(45) **Date of Patent: *Aug. 3, 2021**

(54) HEIGHT ADJUSTABLE TABLE

(71) Applicant: Ergotron, Inc., St. Paul, MN (US)

(72) Inventors: Mustafa Ali Ergun, Eden Prairie, MN (US); John William Theis, St. Paul, MN (US); Michael John Mullen, West Linn, OR (US)

(73) Assignee: Ergotron, Inc., St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/779,313

(22) Filed: Jan. 31, 2020

(65) Prior Publication Data

US 2020/0237093 A1 Jul. 30, 2020

Related U.S. Application Data

(63) Continuation of application No. 15/763,803, filed as application No. PCT/US2016/055704 on Oct. 6, 2016, now Pat. No. 10,602,840.

(Continued)

(51) Int. Cl.
*A47B 21/02* (2006.01)
*A47B 9/20* (2006.01)

(Continued)

(52) U.S. Cl.
CPC ..... *A47B 21/02* (2013.01); *A47B 9/00* (2013.01); *A47B 9/02* (2013.01); *A47B 9/20* (2013.01);

(Continued)

(58) Field of Classification Search
CPC .. A47B 21/02; A47B 9/00; A47B 9/20; A47B 17/02; A47B 2200/0052; A47B 2200/0046; A47B 2200/0041
See application file for complete search history.

(56) References Cited

U.S. PATENT DOCUMENTS 1,824,822 A 9/1931 Kradolfer
2,545,515 A 3/1951 Gannett et al.

(Continued)

FOREIGN PATENT DOCUMENTS

AU 2015247798 B2 6/2018
CN 101744453 6/2010

(Continued)

OTHER PUBLICATIONS

"Application file No. PCT/US2016/055704 International Preliminary Report on Patentability dated Apr. 19, 2018", 9 pgs.

(Continued)

*Primary Examiner* — Daniel J Rohrhoff
(74) *Attorney, Agent, or Firm* — Schwegman Lundberg & Woessner, P.A.

(57) ABSTRACT

A height adjustable table can include a plurality of legs, a lower portion, a worksurface, a height adjustable surface, and a linkage. The worksurface can be supported by the plurality of legs and can include a fixed surface and a height adjustable surface. The fixed surface can be secured to at least one of the lower portion and the plurality of legs, and the fixed surface can define a recessed portion. The height adjustable surface can be movable between a raised position and a lowered position so that the height-adjustable surface retracts into the recessed portion when in the lowered position so that the height adjustable surface is coplanar with the fixed surface. The linkage can be configured to move the height adjustable surface between the lowered position and the raised position so that the height adjustable surface remains parallel to the fixed surface.

15 Claims, 21 Drawing Sheets

Related U.S. Application Data

(60) Provisional application No. 62/239,055, filed on Oct. 8, 2015.

(51) Int. Cl.
*A47B 9/02* (2006.01)
*A47B 9/00* (2006.01)
*A47B 13/08* (2006.01)

(52) U.S. Cl.
CPC .... *A47B 13/088* (2013.01); *A47B 2200/0046* (2013.01); *A47B 2200/0052* (2013.01)

(56) References Cited

U.S. PATENT DOCUMENTS 2,579,577 A 12/1951 Fayra
2,581,023 A 1/1952 Jerick
2,630,359 A 3/1953 Schade
2,643,922 A 6/1953 Rudman
2,727,799 A 12/1955 Keal
2,798,641 A 7/1957 Coddington
3,203,373 A 8/1965 King et al.
3,245,366 A 4/1966 Fox
3,347,184 A 10/1967 Kiraly
3,727,245 A 4/1973 Gerth
3,888,451 A 6/1975 Lacey
4,032,103 A 6/1977 Ehrichs
4,073,240 A 2/1978 Fly
4,130,069 A 12/1978 Evans et al.
4,194,452 A * 3/1980 Crowther ..... A47B 9/00 108/138
4,515,086 A 5/1985 Kwiecinski et al.
4,534,544 A 8/1985 Heide
4,558,847 A 12/1985 Coates et al.
4,577,821 A 3/1986 Edmo et al.
4,589,621 A 5/1986 Hunt et al.
4,625,657 A 12/1986 Little et al.
4,728,118 A 3/1988 Haas
4,981,052 A 1/1991 Gierer
4,981,085 A 1/1991 Watt
5,039,054 A 8/1991 Pai
5,048,784 A 9/1991 Schwartz et al.
5,083,512 A 1/1992 Newhouse et al.
5,088,676 A 2/1992 Orchard et al.
5,174,223 A 12/1992 Nagy et al.
5,192,053 A 3/1993 Sehlstedt
5,251,864 A 10/1993 Itou
5,322,025 A * 6/1994 Sherman ..... A47B 9/10 108/147
5,325,794 A 7/1994 Hontani
5,375,514 A 12/1994 Dann, Jr.
5,394,809 A 3/1995 Feldpausch et al.
5,490,466 A 2/1996 Diffrient
5,503,086 A 4/1996 Hoffman et al.
5,549,052 A 8/1996 Hoffman
5,553,550 A 9/1996 Doyle
5,588,377 A 12/1996 Fahmian
5,649,493 A 7/1997 Blume
5,680,820 A 10/1997 Randolph
5,687,655 A 11/1997 Weinschenk, Jr. et al.
5,778,799 A 7/1998 Eyre
5,794,911 A 8/1998 Hill
5,823,120 A 10/1998 Holmquist
5,833,198 A 11/1998 Graetz
5,938,340 A 8/1999 Brodersen
5,967,059 A 10/1999 Jensen
6,026,755 A 2/2000 Long
6,038,986 A 3/2000 Ransil et al.
6,283,047 B1 9/2001 Haller(-Hess)
6,286,441 B1 9/2001 Burdi
6,378,446 B1 4/2002 Long
6,439,657 B1 8/2002 Tholkes
6,510,803 B1 1/2003 Agee
6,516,478 B2 2/2003 Cook et al.
6,520,091 B1 2/2003 Dettmers
6,603,157 B2 8/2003 Dupuy et al.
6,691,626 B2 2/2004 Warner
6,701,853 B1 3/2004 Hwang
6,874,431 B1 4/2005 Danna
6,991,199 B2 1/2006 Carpentier
7,048,236 B2 5/2006 Benden
7,059,254 B2 6/2006 Strong et al.
7,201,108 B2 4/2007 Eusebi et al.
7,246,784 B1 7/2007 Lopez
7,385,376 B2 6/2008 Zolfaghari
7,548,051 B1 6/2009 Tenbroek et al.
7,642,759 B2 1/2010 Dobkin
7,654,208 B2 2/2010 Patten et al.
7,677,518 B2 * 3/2010 Chouinard ..... A47B 21/02 248/370
7,690,317 B2 4/2010 Beck et al.
7,849,789 B1 12/2010 Whelan
7,887,014 B2 2/2011 Lindblad et al.
7,950,338 B2 5/2011 Smed
8,065,966 B1 11/2011 Bacon et al.
8,132,518 B2 3/2012 Kim et al.
8,439,319 B2 5/2013 Page et al.
8,544,391 B2 10/2013 Knox et al.
8,671,853 B2 3/2014 Flaherty
8,783,639 B2 7/2014 Lindblad et al.
8,800,454 B2 8/2014 Jones
8,931,750 B2 1/2015 Kohl et al.
8,950,343 B2 2/2015 Huang
9,049,923 B1 6/2015 Delagey
9,055,810 B2 6/2015 Flaherty
9,072,645 B2 7/2015 Gamman et al.
9,113,703 B2 8/2015 Flaherty
9,668,572 B2 6/2017 Ergun et al.
10,244,861 B1 * 4/2019 Poniatowski ..... A47B 9/16
10,524,565 B2 1/2020 Ergun et al.
10,542,817 B2 1/2020 Swartz et al.
10,602,840 B2 * 3/2020 Ergun ..... A47B 9/20
11,033,102 B2 6/2021 Ergun et al.
2002/0189505 A1 12/2002 Markofer
2003/0213415 A1 11/2003 Ross et al.
2004/0047645 A1 3/2004 No et al.
2004/0187742 A1 9/2004 Eusebi et al.
2004/0227443 A1 11/2004 Sandoval
2005/0248239 A1 11/2005 Newhouse
2005/0279261 A1 12/2005 Lo
2006/0037518 A1 2/2006 Lopez Alba
2006/0038383 A1 2/2006 Wu
2006/0157628 A1 7/2006 Mileos et al.
2007/0163475 A1 7/2007 Murphy
2007/0259554 A1 11/2007 Lindblad
2007/0266912 A1 11/2007 Swain et al.
2007/0295882 A1 12/2007 Catton
2008/0308016 A1 12/2008 Meyer
2009/0179121 A1 7/2009 Lindblad et al.
2010/0242174 A1 9/2010 Morrison, Sr. et al.
2010/0257671 A1 10/2010 Shimada et al.
2011/0120351 A1 5/2011 Shoenfeld
2011/0168062 A1 7/2011 Dellavecchia
2011/0247532 A1 10/2011 Jones
2013/0014674 A1 1/2013 Burkhalter
2013/0139736 A1 6/2013 Flaherty
2013/0145972 A1 6/2013 Knox et al.
2013/0199420 A1 8/2013 Hjelm
2013/0340655 A1 12/2013 Flaherty
2014/0020606 A1 1/2014 Benden
2014/0041554 A1 2/2014 Huang
2014/0144352 A1 5/2014 Roberts
2014/0158026 A1 6/2014 Flaherty
2014/0165882 A1 6/2014 Plikat et al.
2014/0360411 A1 12/2014 Hatter
2015/0164218 A1 * 6/2015 Bonuccelli ..... A47B 9/20 108/147.19
2015/0216296 A1 8/2015 Mitchell
2015/0231992 A1 8/2015 Gandall et al.
2015/0250303 A1 9/2015 Flaherty
2015/0289641 A1 10/2015 Ergun et al.
2016/0120300 A1 5/2016 Ergun et al.
2016/0198853 A1 7/2016 Liu
2016/0278515 A1 9/2016 Ergun et al.

(56) References Cited

U.S. PATENT DOCUMENTS

| | | | | |
|---|---|---|---|---|
| 2016/0338486 | A1 | 11/2016 | Martin | |
| 2017/0164728 | A1* | 6/2017 | Chang | A47B 37/00 |
| 2017/0354245 | A1 | 12/2017 | Martin et al. | |
| 2017/0360188 | A1* | 12/2017 | Alguire | A47B 83/045 |
| 2018/0103752 | A1 | 4/2018 | Zhong | |
| 2018/0146775 | A1 | 5/2018 | You et al. | |
| 2018/0160799 | A1 | 6/2018 | Westergørd et al. | |
| 2018/0213929 | A1 | 8/2018 | Ergun et al. | |
| 2018/0255919 | A1 | 9/2018 | Swartz et al. | |
| 2018/0279772 | A1 | 10/2018 | Ergun et al. | |
| 2020/0187637 | A1* | 6/2020 | Lin | A47B 21/02 |
| 2020/0221864 | A1 | 7/2020 | Ergun et al. | |

FOREIGN PATENT DOCUMENTS

| | | | |
|---|---|---|---|
| CN | 202681006 | U | 1/2013 |
| CN | 203505908 | U | 4/2014 |
| CN | 106793868 | A | 5/2017 |
| CN | 108024625 | A | 5/2018 |
| DE | 7114367 | U | 6/1972 |
| DE | 4336833 | A1 | 6/1994 |
| DE | 4424564 | A1 | 1/1996 |
| DE | 19517825 | A1 | 11/1996 |
| DE | 102012110389 | A1 | 4/2014 |
| DE | 202016102015 | U1 | 5/2016 |
| EP | 0142919 | A1 | 5/1985 |
| EP | 0229585 | A1 | 7/1987 |
| EP | 0706769 | A2 | 4/1996 |
| EP | 2745733 | A1 | 6/2014 |
| EP | 2842458 | A1 | 3/2015 |
| FR | 1093171 | A | 5/1955 |
| GB | 688572 | A | 3/1953 |
| GB | 857199 | A | 12/1960 |
| GB | 2341790 | A | 3/2000 |
| JP | S5861051 | U | 4/1983 |
| JP | 5950172 | B1 | 7/2016 |
| JP | 2017511246 | A | 4/2017 |
| KR | 101527121 | B1 | 6/2015 |
| WO | WO-9000868 | A1 | 2/1990 |
| WO | WO-90000868 | A1 | 2/1990 |
| WO | WO-9515097 | A1 | 6/1995 |
| WO | WO-9952398 | A1 | 10/1999 |
| WO | WO-2004047645 | A1 | 6/2004 |
| WO | WO-2005041721 | A2 | 5/2005 |
| WO | WO-2015160825 | A2 | 10/2015 |
| WO | WO-2015160825 | A3 | 10/2015 |
| WO | WO-2016129971 | | 8/2016 |
| WO | WO-201609513 | A1 | 12/2016 |
| WO | WO-2016200318 | A1 | 12/2016 |
| WO | WO-2017053200 | A1 | 3/2017 |
| WO | WO-2017062589 | A1 | 4/2017 |

OTHER PUBLICATIONS

"U.S. Appl. No. 14/686,465, Non Final Office Action dated Mar. 9, 2016", 12 pgs.
"U.S. Appl. No. 14/686,465, Non Final Office Action dated Jul. 29, 2016", 11 pgs.
"U.S. Appl. No. 14/686,465, Non Final Office Action dated Nov. 12, 2015", 11 pgs.
"U.S. Appl. No. 14/686,465, Response filed Feb. 8, 2016 to Non Final Office Action dated Nov. 12, 2015", 12 pgs.
"U.S. Appl. No. 14/686,465, Response filed Jul. 11, 2016 to Non Final Office Action dated Mar. 9, 2016", 11 pgs.
"U.S. Appl. No. 14/686,465, Response filed Oct. 28, 2015 to Restriction Requirement dated Aug. 28, 2015", 8 pgs.
"U.S. Appl. No. 14/686,465, Restriction Requirement dated Aug. 28, 2015", 6 pgs.
"U.S. Appl. No. 14/971,227, Advisory Action dated Jan. 23, 2017", 4 pgs.
"U.S. Appl. No. 14/971,227, Final Office Action dated Nov. 2, 2016", 9 pgs.
"U.S. Appl. No. 14/971,227, Final Office Action dated Nov. 8, 2017", 13 pgs.
"U.S. Appl. No. 14/971,227, Non Final Office Action dated Mar. 17, 2017", 14 pgs.
"U.S. Appl. No. 14/971,227, Non Final Office Action dated Jul. 11, 2016", 13 pgs.
"U.S. Appl. No. 14/971,227, Response filed Feb. 27, 2017 to Advisory Action Jan. 23, 2017", 20 pgs.
"U.S. Appl. No. 14/971,227, Response filed Apr. 6, 2016 to Restriction Requirement dated Feb. 11, 2016", 6 pgs.
"U.S. Appl. No. 14/971,227, Response filed Jul. 17, 2017 to Non Final Office Action dated Mar. 17, 2017", 21 pgs.
"U.S. Appl. No. 14/971,227, Response filed Sep. 29, 2016 to Non Final Office Action dated Jul. 11, 2016", 11 pgs.
"U.S. Appl. No. 14/971,227, Response filed Dec. 28, 2016 to Final Office Action dated Nov. 2, 2016", 15 pgs.
"U.S. Appl. No. 14/971,227, Restriction Requirement dated Feb. 11, 2016", 6 pgs.
"U.S. Appl. No. 15/178,794, Examiner Interview Summary dated Dec. 12, 2016", 3 pgs.
"U.S. Appl. No. 15/178,794, Non Final Office Action dated Nov. 15, 2016", 16 pgs.
"U.S. Appl. No. 15/178,794, Notice of Allowance dated Feb. 8, 2017", 7 pgs.
"U.S. Appl. No. 15/178,794, Response filed Aug. 25, 2016 to Restriction Requirement dated Jul. 14, 2016", 7 pgs.
"U.S. Appl. No. 15/178,794, Response filed Dec. 28, 2016 to Non Final Office Action dated Nov. 15, 2016", 19 pgs.
"U.S. Appl. No. 15/178,794, Restriction Requirement dated Jul. 14, 2016", 5 pgs.
"U.S. Appl. No. 15/762,427, Non Final Office Action dated Apr. 24, 2019", 10 pgs.
"U.S. Appl. No. 15/762,427, Notice of Allowance dated Aug. 26, 2019", 7 pgs.
"U.S. Appl. No. 15/762,427, Response filed Mar. 21, 2019 to Restriction Requirement dated Mar. 4, 2019", 7 pgs.
"U.S. Appl. No. 15/762,427, Response filed Jul. 23, 2019 to Non-Final Office Action dated Apr. 24, 2019", 11 pgs.
"U.S. Appl. No. 15/762,427, Restriction Requirement dated Apr. 4, 2019", 7 pgs.
"U.S. Appl. No. 15/763,803, Advisory Action dated Aug. 23, 2019", 3 pgs.
"U.S. Appl. No. 15/763,803, Corrected Notice of Allowability dated Jan. 13, 2020", 2 pgs.
"U.S. Appl. No. 15/763,803, Corrected Notice of Allowability dated Feb. 12, 2020", 2 pgs.
"U.S. Appl. No. 15/763,803, Final Office Action dated May 10, 2019", 12 pgs.
"U.S. Appl. No. 15/763,803, Non Final Office Action dated Dec. 5, 2018", 11 pgs.
"U.S. Appl. No. 15/763,803, Notice of Allowance dated Oct. 1, 2019", 6 pgs.
"U.S. Appl. No. 15/763,803, Notice of Allowance dated Oct. 30, 2019", 6 pgs.
"U.S. Appl. No. 15/763,803, Response filed Mar. 4, 2019 to Non Final Office Action dated Dec. 5, 2018", 11 pgs.
"U.S. Appl. No. 15/763,803, Response filed Aug. 12, 2019 to Final Office Action dated May 10, 2019", 15 pgs.
"U.S. Appl. No. 15/763,803, Response filed Sep. 10, 2019 to Advisory Action dated Aug. 23, 2019", 7 pgs.
"U.S. Appl. No. 15/892,167, Corrected Notice of Allowability dated Nov. 26, 2019", 2 pgs.
"U.S. Appl. No. 15/892,167, Non Final Office Action dated Feb. 19, 2019", 12 pgs.
"U.S. Appl. No. 15/892,167, Notice of Allowance dated Jul. 31, 2019", 5 pgs.
"U.S. Appl. No. 15/892,167, Preliminary Amendment filed Feb. 21, 2018", 8 pgs.
"U.S. Appl. No. 15/892,167, PTO Response to Rule 312 Communication dated Nov. 18, 2019", 2 pgs.
"U.S. Appl. No. 15/892,167, Response filed Jun. 19, 2019 to Non-Final Office Action dated Feb. 19, 2019", 9 pgs.

(56) References Cited

OTHER PUBLICATIONS

"Application Serial No. PCT/US2016/052233, International Preliminary Report on Patentability dated Apr. 5, 2018", 12 pgs.
"Australian Application Serial No. 2015247798, First Examiners Report dated Oct. 31, 2017", 6 pgs.
"Australian Application Serial No. 2015247798, Response filed Jan. 24, 2018 to First Examiners Report dated Oct. 31, 2017", 50 pgs.
"Chinese Application Serial No. 201580024630.5, Voluntary Amendment filed Aug. 25, 2017", w/ claims in English, 13 pgs.
"Computer Taskmate™ HealthPostures Feel Better in motion", [Online], Retrieved from the Internet: <URL: www.healthpostures.com>, 3 pgs.
"Computer Taskmate™ Product Information", [Online]. Retrieved from the Internet: <URL: www.varidesk.com>, 2 pgs.
"European Application No. 15780177.0, Office Action dated Nov. 22, 2016", 2 pg.
"European Application Serial No. 15780177.0, Extended European Search Report dated Feb. 2, 2018", 12 pgs.
"European Application Serial No. 15780177.0, Invitation pursuant to Rule 63(1) EPC dated Oct. 6, 2017", 3 pgs.
"European Application Serial No. 16784658.3, Response filed Dec. 17, 2018 to Communication Pursuant to Rules 161 and 162 dated Jun. 7, 2018", 21 pgs.
"International Application Serial No. PCT/US2015/025780, International Preliminary Report on Patentability dated Oct. 27, 2016", 7 pgs.
"International Application Serial No. PCT/US2015/025780, International Search Report dated Dec. 7, 2015", 2 pgs.
"International Application Serial No. PCT/US2015/025780, Written Opinion dated Dec. 7, 2015", 5 pgs.
"International Application Serial No. PCT/US2016/034156, International Preliminary Report on Patentability dated Jan. 4, 2018", 9 pgs.
"International Application Serial No. PCT/US2016/034156, International Search Report dated Aug. 2, 2016", 3 pgs.
"International Application Serial No. PCT/US2016/034156, Written Opinion dated Aug. 2, 2016", 7 pgs.
"International Application Serial No. PCT/US2016/052233, International Search Report dated Dec. 1, 2017", 6 pgs.
"International Application Serial No. PCT/US2016/052233, Invitation to Pay Add'l Fees and Partial Search Report dated Nov. 8, 2016", 6 pgs.
"International Application Serial No. PCT/US2016/052233, Written Opinion dated Dec. 1, 2017", 10 pgs.
"International Application Serial No. PCT/US2016/055704, International Search Report dated Dec. 20, 2016", 5 pgs.
"International Application Serial No. PCT/US2016/055704, Written Opinion dated Dec. 20, 2016", 7 pgs.
"Office Theme", [Online]. Retrieved from the Internet: <URL: varidesk.com>, 6 pgs.
"Sales Order Form re: Taskmate", Products shipped from HealthPostures, LLC. to ARC Ergonomics, (Sep. 30, 2008), 2 pgs.
Dai, et al., "CN 107048694 (A), Drawings and Abstract", Derwent—Thomson Reuters, (2017), 3 pgs.
"U.S. Appl. No. 16/709,228, Non Final Office Action dated Apr. 20, 2020", 10 pgs.
"U.S. Appl. No. 16/709,228, Preliminary Amendment filed Jan. 30, 2020", 8 pgs.
"Canadian Application Serial No. 2,999,757, Office Action dated Jan. 18, 2019", 4 pgs.
"Canadian Application Serial No. 2,999,757, Response filed Jul. 17, 2019 to Office Action dated Jan. 18, 2019", 16 pgs.
"Chinese Application Serial No. 201580024630.5, Office Action dated Aug. 5, 2019", w/ English Translation, 16 pgs.
"Chinese Application Serial No. 201580024630.5, Office Action dated Dec. 29, 2018", w/ English translation, 23 pgs.
"Chinese Application Serial No. 201580024630.5, Response filed May 13, 2019 to Office Action dated Dec. 29, 2018", w/ English claims, 13 pgs.
"European Application Serial No. 16777839.8, Communication Pursuant to Article 94(3) EPC dated Jun. 5, 2019", 4 pgs.
"European Application Serial No. 16777839.8, Communication Under Rule 164(2)(a) EPC dated Feb. 20, 2019", 4 pgs.
"European Application Serial No. 16777839.8, Response filed Oct. 9, 2018 to Communication Pursuant to Rules 161 and 162 EPC dated May 7, 2018", 20 pgs.
"European Application Serial No. 18175257.7 Extended European Search Report dated Nov. 2, 2018", 9 pgs.
"European Application Serial No. 18175257.7 Response filed Jul. 2, 2019 to Extended European Search Report dated Nov. 2, 2018", 17 pgs.
"U.S. Appl. No. 16/709,228, Corrected Notice of Allowability dated Dec. 11, 2020", 4 pgs.
"U.S. Appl. No. 16/709,228, Final Office Action dated Aug. 4, 2020", 9 pgs.
"U.S. Appl. No. 16/709,228, Notice of Allowance dated Feb. 24, 2021", 6 pgs.
"U.S. Appl. No. 16/709,228, Notice of Allowance dated Oct. 27, 2020", 8 pgs.
"U.S. Appl. No. 16/709,228, Response filed Jul. 20, 2020 to Non Final Office Action dated Apr. 20, 2020", 14 pgs.
"U.S. Appl. No. 16/709,228, Response filed Oct. 5, 2020 to Final Office Action dated Aug. 4, 2020", 16 pgs.
"European Application Serial No. 16784658.3, Communication Pursuant to Article 94(3) EPC dated Dec. 8, 2020", 6 pgs.
"U.S. Appl. No. 16/709,228, Corrected Notice of Allowability dated Apr. 21, 2021", 2 pgs.
"U.S. Appl. No. 16/709,228, Corrected Notice of Allowability dated May 11, 2021", 2 pgs.

* cited by examiner

HEIGHT ADJUSTABLE TABLE

CLAIM OF PRIORITY

This patent application is a continuation of U.S. patent application Ser. No. 15/763,803, titled "HEIGHT ADJUSTABLE TABLE," by Mustafa A. Ergun et al., and filed on Mar. 27, 2018, which is a U.S. National Stage Filing under 35 U.S.C. § 371 of International Patent Application No. PCT/US2016/055704, titled "HEIGHT ADJUSTABLE TABLE," by Mustafa A. Ergun et al., and filed on Oct. 6, 2016, and published on Apr. 13, 2017, as WO 2017/062589 A1, which claims the benefit of U.S. Provisional Patent Application Ser. No. 62/239,055, titled "HEIGHT ADJUSTABLE TABLE," by Mustafa A. Ergun et al., and filed on Oct. 8, 2015, which are hereby incorporated by reference herein in their entirety.

TECHNICAL FIELD

This document pertains generally, but not by way of limitation, to an assembly for providing a height adjustable worksurface.

BACKGROUND

Electronic computers, e.g., laptop computers and desktop computers, are popular in many industries for increasing working efficiency and productivity. Unfortunately, the design features of computers make them ergonomically uncomfortable to use, especially for long periods of time. Some stands and desks have been provided to allow for some position adjustability, but many of these stands only allow a user to set the position of the stand in a relatively few pre-set positions, or are generally difficult to adjust.

OVERVIEW

In an example, this disclosure is directed to a height adjustable table, which can include a plurality of legs, a lower portion, a worksurface, a height adjustable surface, and a linkage. The lower portion can be coupled to and supported by the plurality of legs. The worksurface can be supported by the plurality of legs and can include a fixed surface and a height adjustable surface. The fixed surface can be secured to at least one of the lower portion and the plurality of legs, and the fixed surface can define a recessed portion. The height adjustable surface can be coupled to at least one of the lower portion and the fixed surface. The height adjustable surface can be movable between a raised position and a lowered position so that the height-adjustable surface retracts into the recessed portion when in the lowered position so that the height adjustable surface is coplanar with the fixed surface. The linkage can be configured to move the height adjustable surface between the lowered position and the raised position so that the height adjustable surface remains parallel to the fixed surface. The linkage can include an upper end and a lower end. The upper end can be coupled to the height adjustable surface and the lower end can be coupled to at least one of the fixed surface and the lower portion.

In another example, this disclosure is directed to a height adjustable table that can include a worksurface, a base, a telescoping riser, and a linkage. The worksurface can be movable between a raised position and a lowered position. The telescoping riser can include a stationary member coupled to the base and a movable member coupled to the worksurface. The movable member can be nestable within the stationary member, and can be extendable from and retractable into the stationary member. The linkage can be configured to move the height adjustable surface between the lowered position and the raised position so that the height adjustable surface remains parallel to the fixed surface The linkage can include an upper end coupled to the height adjustable surface, and can include a lower end coupled to at least one of the fixed surface and the lower portion.

In another example, this disclosure is directed to a height adjustable table that can include a work surface, a base, a first telescoping riser, and a second telescoping riser. A worksurface can be movable between a raised position and a lowered position. The base can be spaced from the worksurface. The first telescoping riser can include a first stationary member, a first movable member, and a first linkage. The first stationary member can be coupled to the base near a first side of the base. The first movable member can be coupled to the worksurface near a first side of the worksurface. The first movable member can be nestable within the first stationary member and can be extendable from and retractable into the first stationary member. The first linkage can be enclosed in the first stationary member and can be rotatably coupled to the first movable member and the base. The first linkage can be configured to extend and retract the first movable member. The second telescoping riser can include a second stationary member, a second movable member, and a second linkage. The second stationary member can be coupled to the base near a second side of the base. The second movable member can be coupled to the worksurface near a second side of the worksurface. The second movable member can be nestable within the second stationary member, and can be extendable from and retractable into the second stationary member. The second linkage can be enclosed in the second stationary member and can be rotatably coupled to the second movable member and the base. The second linkage can be configured to extend and retract the second movable member.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
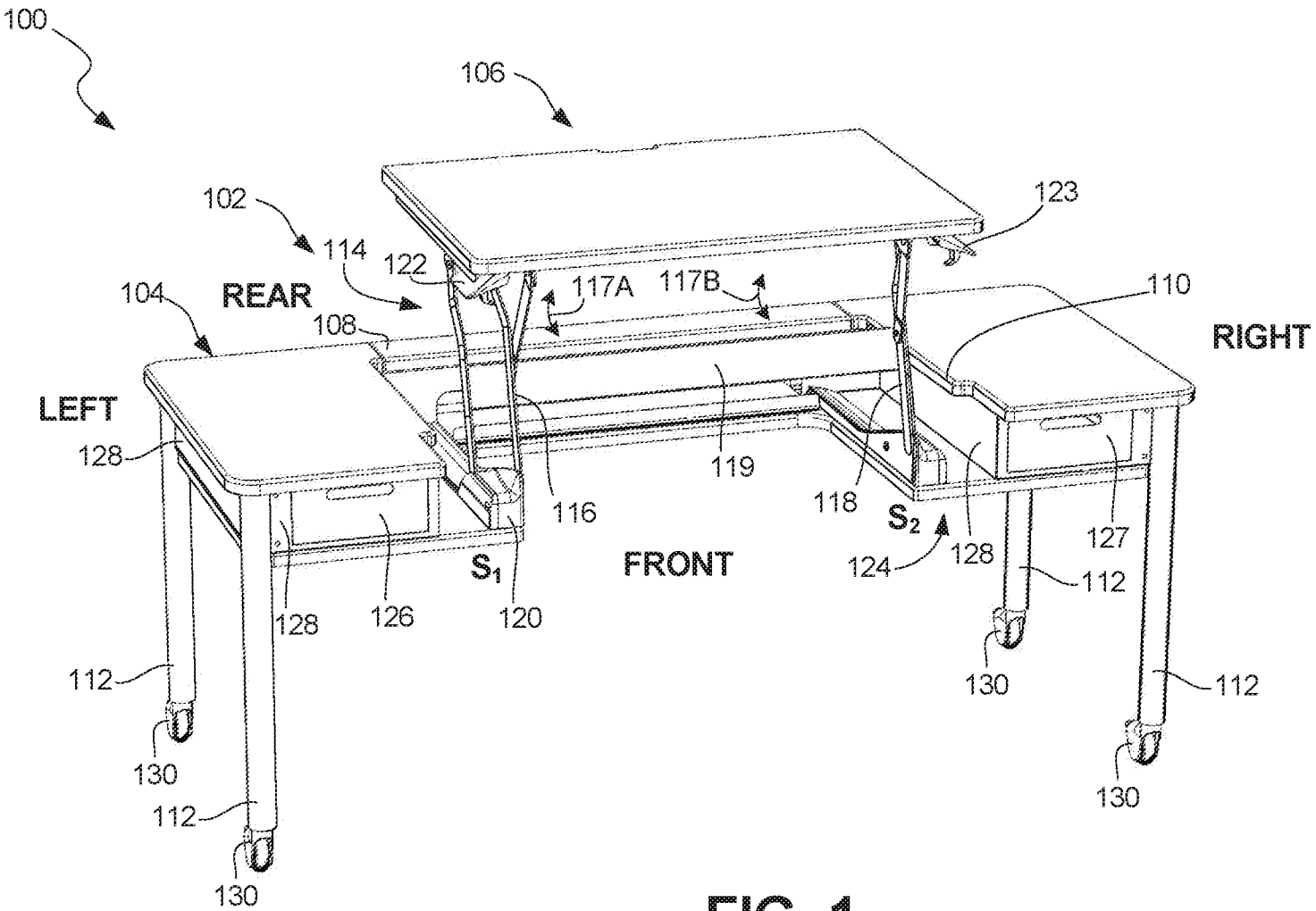
FIG. 1 illustrates a perspective view of a table with a recessed section and height adjustment mechanism, in accordance with at least one example of this disclosure.

Generally, FIG. 1 illustrates a perspective view of a table with a recessed section and height adjustment mechanism, in accordance with at least one example of this disclosure. The table surface can be divided into two main areas: a first portion and a second portion. The first portion is not height adjustable and the second portion can be height adjustable. Also, the table can define a recessed section that can be located between the left and right sides of the table. The recessed section can provide a cutout in the table that can provide space for a height adjustable worksurface.

The height adjustable worksurface is illustrated in FIG. 1 as the second portion and the two terms are interchangeable throughout the application. The height adjustable worksurface can be located in the recessed area when the height adjustable worksurface is in a lowered position. In the lowered position, the surface of the height adjustable worksurface can be located in the same plane or level as the remainder of the table top. The height adjustable worksurface can be raised to an upper position to facilitate standing working positions or raising the height adjustable worksurface for viewing, accessing, displaying, or space saving purposes.

The height adjustment mechanism can include a 4-bar mechanism, the bottom of which can be coupled to the lower surface of the table at a lower bar or foot bracket. The top of the 4-bar mechanism can be coupled to an underside or bottom of the height adjustable worksurface. The table can include a portion surrounding the recessed section that can include a dimension or clearance that separates the upper and lower table surfaces. The dimension separating the table upper and lower surfaces can be configured for the location of side compartments, a rear compartment, and drawers. These examples are discussed more specifically, below.

FIG. 1 illustrates a perspective view of table 100 with height adjustable surface 106 shown in a raised position, in accordance with at least one example of this disclosure. Table 100 can include worksurface 102, which can include fixed surface 104 and height adjustable surface 106. Fixed surface 104 can include rear compartment surface 108 and recessed portion 110. Table 100 can additionally include legs 112 and height adjustment mechanism 114, which can include linkage 116, linkage 118, cross-member 119, counterbalance mechanism 120, and levers 122 and 123. Table 100 can also include lower portion 124, drawers 126 and 127, and closure pieces 128. Legs 112 can include wheels 130, as in the example shown in FIG. 1, but legs 112 may include casters or feet in some examples. Also shown in FIG. 1 are sides S1 and S2 of recessed portion 110 and orientation indicators left, right, front, and rear.

In the example shown in FIG. 1, legs 112 couple to and support lower portion 124. Legs 112 also couple to and support worksurface 102. In some examples, legs 112 can support and secure only lower portion 124, which can then support and secure worksurface 102. In some examples, legs 112 can support and secure only worksurface 102, which can then support and secure lower portion 124.

In some example configurations, closure pieces 128 can couple to legs 112 and can also couple to lower portion 124 and worksurface 102. In some examples, closure pieces 128 can support and secure one or both of worksurface 102 and lower portion 124. Closure pieces 128 can also enclose openings between lower portion 124 and worksurface 102 and can be used to create openings for drawers 126 and 127, which can extend from and retract into table 100.

Figure 2:
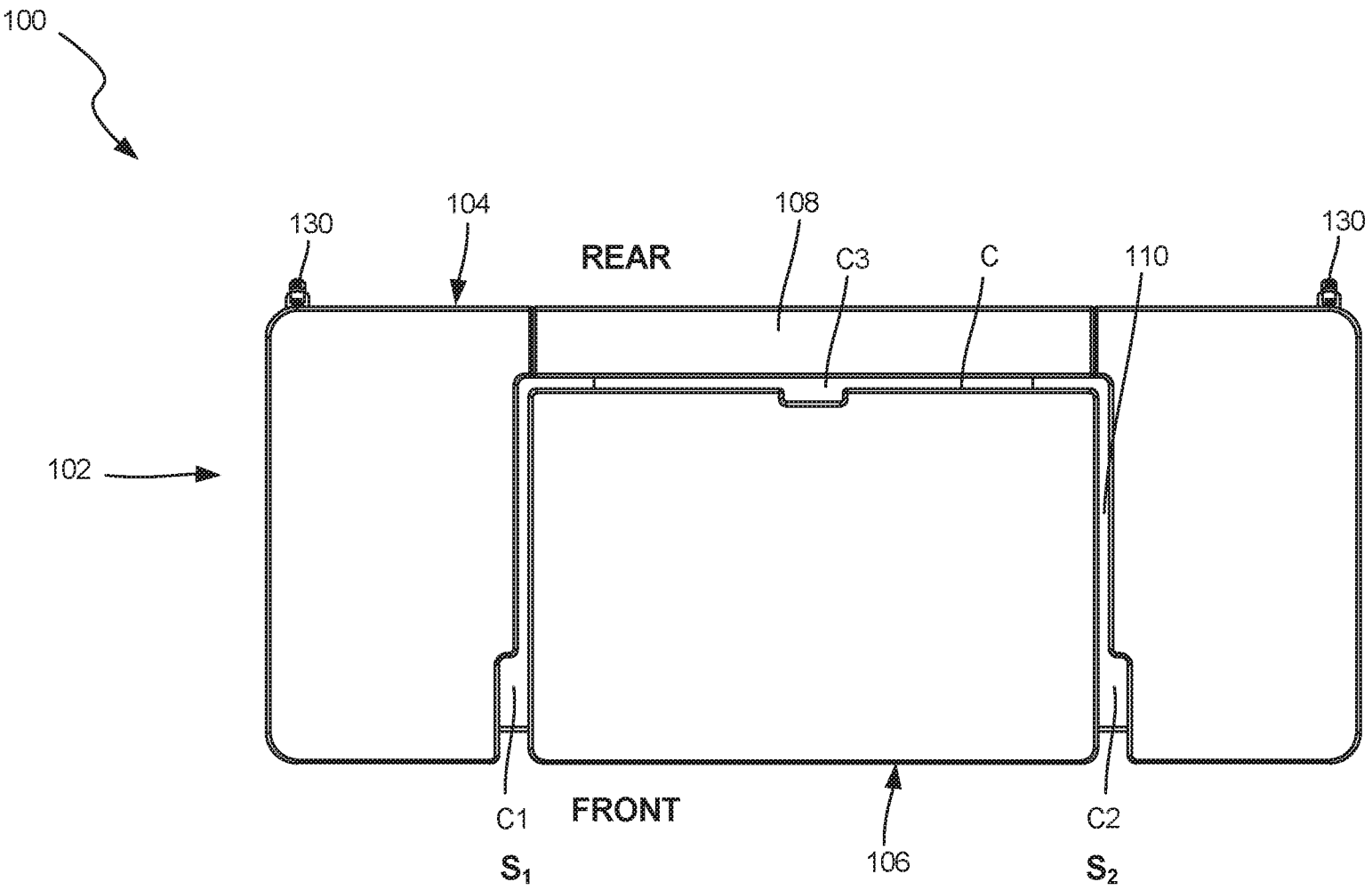
FIG. 2 illustrates a top view of a table with a recessed section and height adjustment mechanism, in accordance with at least one example of this disclosure.

In some example configurations, fixed surface 104 is a generally planar working surface having a cutout that, together with lower portion 124 and closure pieces 128, can define recessed or cutout portion 110. Recessed portion 110 can be sized so that height adjustable surface 106 fits into recessed portion 110 with little clearance between the periphery of height adjustable surface 106 and the periphery of the cutout of fixed surface 104 (as shown in FIG. 2). Recessed portion 110 can also have a depth to accommodate the components of height adjustment mechanism 114 and height adjustable surface 106 so that when height adjustable surface 106 is in a lowered position, height adjustable surface 106 and fixed surface 104 are generally coplanar such that worksurface 102 is generally planar.

In the example configuration shown in FIG. 1, height adjustment mechanism 114 can be coupled to lower portion 124. In some example configurations, height adjustment mechanism 114 can be coupled at one end to closure pieces 128 or to an underside of fixed surface 104. In some examples configuration height adjustment mechanism can be coupled to legs 112. Height adjustment mechanism 114 can be coupled at another end to height adjustable surface 106.

More specifically, linkage 116 can be disposed on side S1 of recessed portion 110 and linkage 118 can be disposed on side S2 of recessed portion 110. In the example shown in FIG. 1, counterbalance mechanism 120 can be coupled to linkage 16 and to lower portion 124 on side S1, but in some examples, counterbalance mechanism 120 can be coupled to linkage 18 and to lower portion 124 on side S2. Counterbalance mechanism 120 can be coupled to another part of height adjustment mechanism 114 and another fixed portion of table 100, in some example configurations. In some examples, there can be two or more of counterbalance mechanisms 120 coupled to each of linkages 116 and 118, or multiple counterbalance mechanisms 120 can be coupled to only one of linkages 116 and 118.

Linkages 116 and 118 can be a four bar linkage, in some examples, as described below. Linkage 116 can be coupled to lower portion 124 and the underside of height adjustable surface 106 near side S1. Linkage 118 can be coupled to lower portion 124 on side S2 and can also be coupled to the underside of height adjustable surface 106 near side S2. In some examples, linkages 116 and 118 can be coupled to linkage height adjustable surface 106 and table 100 in other locations. Crossbar 119 can be coupled to and extend between linkage 116 and 118. In some example configurations, levers 122 and 123 can be mounted to the underside height adjustable surface 106 near sides S1 and S2.

Figure 3:
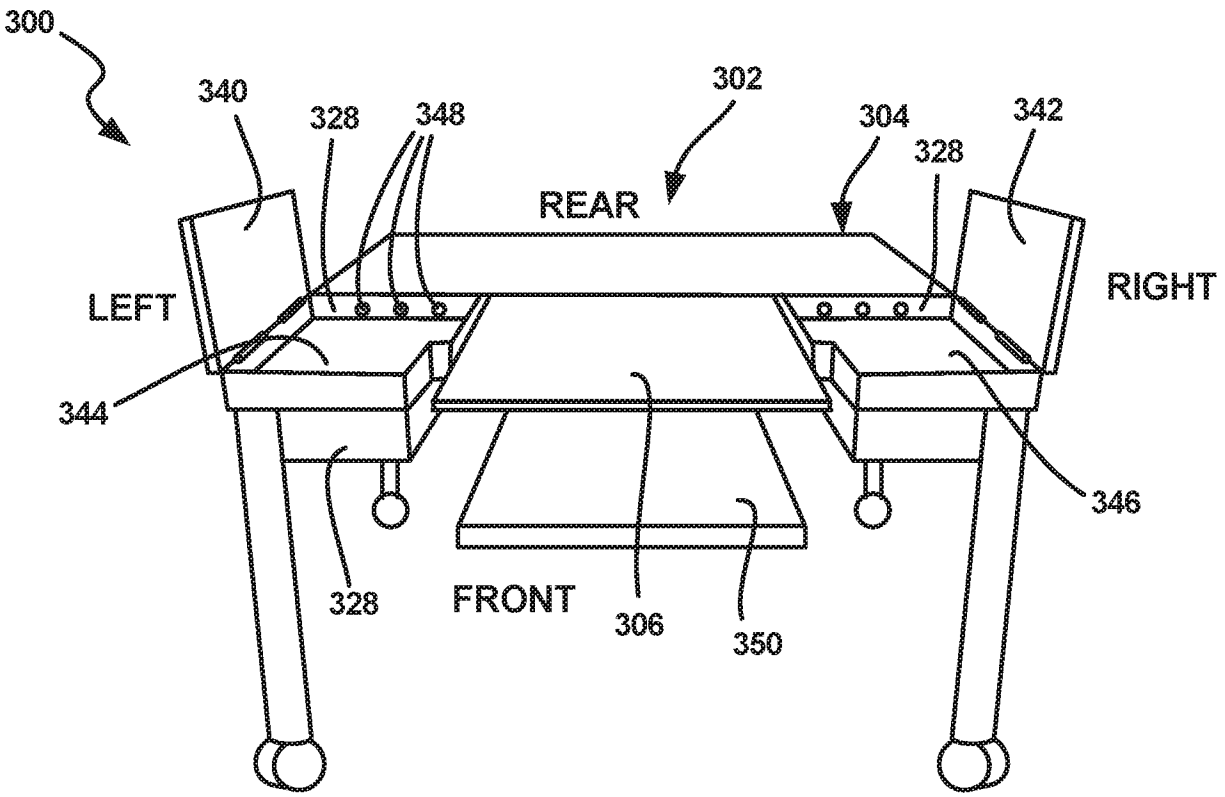
FIG. 3 illustrates a front perspective view of the table with height adjustable worksurface, and side storage compartments with flip-up doors and optional sliding keyboard tray, in accordance with at least one example of this disclosure.
Figure 4:
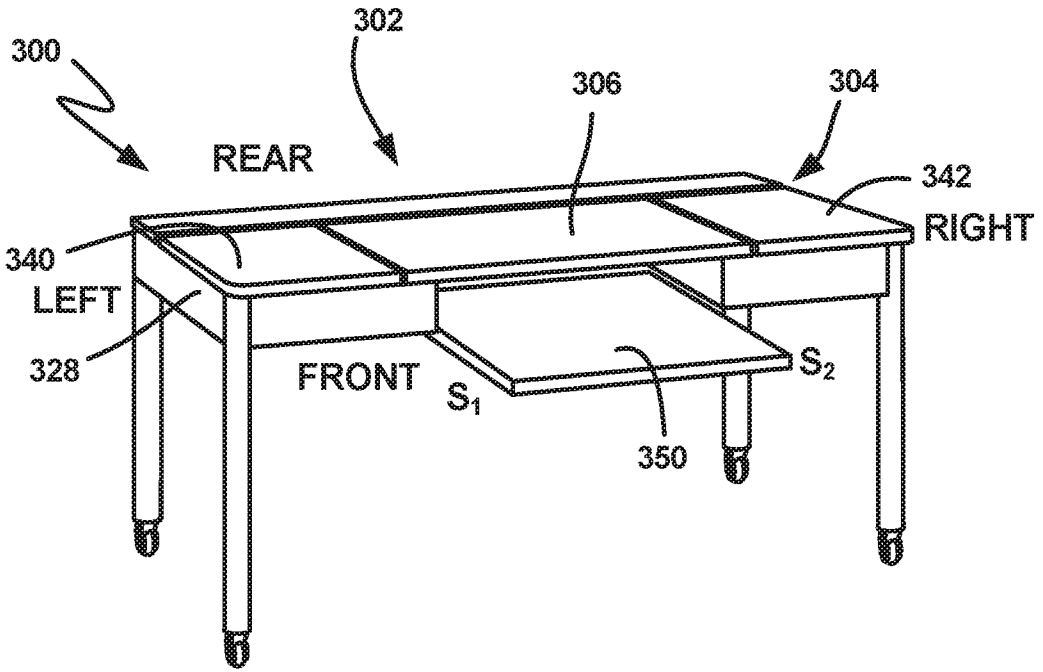
FIG. 4 illustrates a perspective view of the table with height adjustable worksurface and slide-out keyboard tray, in accordance with at least one example of this disclosure.

In operation of the example shown in FIG. 1, height adjustable surface 106 is movable between a raised position (as shown in FIG. 1) and a lowered position (as shown in FIGS. 3 and 4, for example). While in the raised position, height adjustable surface 106 is elevated above and generally planar with fixed surface 104, and can be used, for example, while standing. While in the lowered position, height adjustable surface 106 is generally coplanar with fixed surface 104, making worksurface 102 generally planar, and can be used, for example in a sitting or other position. In some examples, height adjustable surface can be configured to not be substantially coplanar with fixed surface 104 and to maintain a relative orientation between fixed surface 104 and height adjustable surface 106 between the raised and lowered positions.

More specifically, in operation of some examples, a user can actuate one or both of levers 122 and 123 to unlock linkage 116 and linkage 118. In some examples lever 122 disposed near side S1 can individually lock and unlock linkage 116 and lever 123 disposed near side S2 can individually lock and unlock linkage 118. When one or both of levers 122 and 123 unlock linkage 116 and linkage 118, height adjustable surface 106 can be adjusted between the lowered position and the raised position. Linkage 116 and linkage 118 allow height adjustable surface 106 to move between the raised and lowered positions, while keeping height adjustable surface 106 in a plane generally parallel to fixed surface 104.

For example, as shown in FIG. 1, height adjustable surface 106 is in a raised position. In operation of some examples, a user can actuate one of levers 122 and 123 to release or unlock linkage 116 and linkage 118. The user can then lower height adjustable surface 106 to a lowered position or to a position between the raised and lowered position. For example, height adjustable surface 106 can have several heights at which height adjustable surface can be locked between the raised and lowered positions, such as 2, 3, 4, 6, 10, 20 or more heights. The user can then, for example, choose a suitable height for height adjustable surface 106 and can then release one of levers 122 and 123 to lock linkages 116 and 118, securing height adjustable surface 106 at the suitable height.

A user can raise height adjustable surface 106 using a similar process. For example, if height adjustable surface 106 is in the lowered position, a user can actuate one of levers 122 and 123 to release or unlock linkage 116 and linkage 118. The user can then raise height adjustable surface 106 to the raised position or to a position between the raised and lowered positions. The user can then, for example, choose a suitable height for height adjustable surface 106 and can release lever 122 and 123 to lock linkages 116 and 118, securing height adjustable surface 106 at the suitable height, for example in the raised position (as shown in the example of FIG. 1).

Counterbalance mechanism 120 can apply a force on linkage 116 to compensate for the weight of the components of height adjustment mechanism 114, the weight of height adjustable surface 106, and any components resting on height adjustable surface 106. In some example configurations, counterbalance mechanism 120 can include an energy storage member such as a spring, a gas cylinder, an electronic actuator, or a hydraulic actuator. In some examples, a user can use counterbalance mechanism 120 to automatically adjust the height of height adjustable surface 106 through a controller or other user interface (not shown).

Height adjustable surface 106 can be raised to an upper position to facilitate standing working positions or raising height adjustable surface 106 for viewing, accessing, displaying, or space saving purposes. Table 100 may offer additional benefits of a height adjustable surface 106 that is built into table 100. Table 100 may also offer the benefit of raising only a portion of height adjustable surface 106, which can allow less force to be used, making height adjustable surface 106 easier for a user to adjust, or can allow lower power consumption of a powered counterbalance 120.

Worksurface 102 (which can include fixed surface 104 and height adjustable surface 106), legs 112, lower portion, drawers 126 and 127, and closure pieces 128 can be comprised of wood or other fibrous materials in some examples, and can be comprised of other materials suitable to construct components of table 100, such as plastic, aluminum, steel, and the like.

Wheels 130 can be lockable journal bearing wheels, in some example configurations, and can be of another wheel type, such as a caster, in some examples. In operation of some examples, wheels 130 allow table 100 to be easily moved, positioned, or transported without lifting table 100.

In some examples, rear compartment surface 108 can be coupled to fixed surface 104 with a hinge, linkage, and the like. In other examples, rear compartment surface 108 can be coupled to another portion of table 100. In operation of some examples, rear compartment surface 108 can rotate upward via a hinge, as indicated by arrows 117A, 117B in the example shown in FIG. 1, to expose a storage compartment, and can rotate downward into a closed position so that the top of rear compartment surface 108 is generally coplanar with the fixed surface 104 and height adjustable surface 106.

FIG. 2 is a plan or top view of table 100 of FIG. 1 in accordance with at least one example of this disclosure. Table 100 can include worksurface 102, which can include fixed surface 104 and height adjustable surface 106. Fixed surface 104 can include rear compartment surface 108 and recessed portion 110. Table 100 can also include wheels 130. Also shown in FIG. 2 are sides S1 and S2, front and rear sides of table 100, and clearance C, which can include clearances C1, C2, and C3.

The components of table 100 as shown in FIG. 2 can be connected and operate consistently with table 100 as shown in FIG. 1. FIG. 2 shows how height adjustable surface 106 fits within fixed surface 104.

Height adjustable surface 106 has a geometric shape that is configured to fit or nest within recessed portion 110 of fixed surface 104 with clearance C in between height adjustable surface 106 and fixed surface 104. In the example shown in FIG. 2, height adjustable surface 106 has a substantially rectangular prism shape, (or a rectangular shape from the plan view perspective), which nests within the substantially rectangular opening created by recessed portion 110. In some examples, height adjustable surface 106 can have other geometric shapes. For example, height adjustable surface 106 can have a trapezoidal prism shape, a triangular prism shape, and the like, that can nest within a recessed portion 110 having a complementary shape configured accept the shape of height adjustable surface 106.

In the example shown in FIG. 2, recessed section 110 is illustrated as being centered between right and left sides of table 100. However, in some examples, recessed section 110 can be located in a position that is not centered in the table Fixed surface 104 and height adjustable surface 102 can include cutouts for grasping height adjustable surface 102 or for raising or lowering operations. In the example shown in FIG. 2, clearance C, between height adjustable surface 106 and fixed surface 104 can include clearances C1, C2, and C3. Clearances C1 and C2 can be formed by cutouts or undercuts in the internal perimeter of fixed surface 104. In some examples, clearance C1 is positioned at side S1 at the front of worksurface 102 and clearance C2 is positioned at side S2 at the front of worksurface 102. In some examples, clearances C1 and C2 can be located at other locations around the perimeter of height adjustable surface 106, for example, when levers 122 and 123 can be disposed in other locations. Clearances C1 and C2 provide access to levers 122 and 123, respectively, from above when height adjustable surface 106 is in or near the lowered position. In some examples, there can be additional clearances C for access to additional levers 122 and 123, or other components. In some examples, there can be fewer of clearances C.

FIG. 2 also shows clearance C3, located toward the rear of worksurface 102 between height adjustable surface 106 and rear compartment surface 108. In the example shown in FIG. 2, clearance C3 is centered about height adjustable surface 106 between sides S1 and S2, but can be off center in some examples. Clearance C3 can be used to route electrical cords, cables, and the like, which can help to avoid binding of electrical cords during adjustments to height adjustable surface 106.

FIG. 3 illustrates a front perspective view of table 300 with left side door 340 and right side door 342 in closed positions in accordance with at least one example of this disclosure. FIG. 4 illustrates a perspective view of table 300 with left side door 340 and right side door 342 in open positions in accordance with at least one example of this disclosure. FIGS. 3 and 4 are discussed concurrently.

Table 300 can include worksurface 302 and closure pieces 328. Worksurface 302 can include fixed surface 304 and height adjustable surface 306. Fixed surface 304 can include left side door 340 and right side door 342, which can provide access to left side compartment 344 and right side compartment 346, respectively. Left side compartment 344 and right side compartment 346 include cutouts 348. Table 300 also can include sliding keyboard tray 350.

In the example shown in FIGS. 3 and 4, fixed surface 304 can include left and right side doors 340 and 342, respectively, which can be substantially coplanar with the remainder of fixed surface 304 and height adjustable surface 306 to make worksurface 302 generally planar when height adjustable surface 306 is in a lowered position, as shown in FIGS. 3 and 4. Thought not shown in FIGS. 3 and 4, height adjustable surface 306 can have its height adjusted by a user, as described in the examples above.

In the example shown in FIG. 3, left side door 340 can have a hinge, or multiple hinges, coupled to a portion of the left side of fixed surface 304 or another part of table 300. Similarly, right side door 342 can have a hinge, or multiple hinges, coupled to a portion of the right side of fixed surface 304 or another part of table 300. In operation of the example shown in FIGS. 3 and 4, left side door 340 can be in a closed position (as shown in FIG. 4), and can be rotated about its hinge toward the left side of table 300 to expose left side compartment 344 (as shown in FIG. 3). Similarly, right side door 342 can be in a closed position (as shown in FIG. 4) and can be rotated about its hinge toward the right side of table 300 to expose right side compartment 346 (as shown in FIG. 3).

In other embodiments, hinges can be coupled to left side and right side doors 340 and 342, respectively, or at other locations. For example, left side door 340 can have a hinge coupled to the rear of left side door 340. Continuing with this example, left side door 340 could be rotated about its rear hinge toward the rear of table 300 to expose left side compartment 344.

When either or both left and right side compartments 344 and 346 are, respectively, exposed, cutouts 348 (shown in FIG. 3) can be accessed. Cutouts 348 can be holes or bores cut into closure pieces 328 that allow electrical cords, and the like, to be passed from left and right side compartments 344 and 346, respectively, to another location, such as underneath table 300 or to a rear compartment, such as rear compartment surface 108 of the example shown in FIGS. 1 and 2. In some examples, cutouts 348 can include grommets.

In the example shown in FIGS. 3 and 4, sliding keyboard tray 350 can be coupled to an underside of height adjustable surface 306. In some examples, sliding keyboard tray 350 can be connected to components of a height adjustment mechanism, such as height adjustment mechanism 114 shown in FIG. 1. The sliding keyboard tray can be located underneath the plane of the height adjustable worksurface and can be retracted when not in use.

Because the sliding keyboard tray 350 can be slidably coupled to height adjustable surface 306, sliding keyboard tray 350 can raise and lower with the height adjustable surface 306, allowing keyboard work to be performed at all adjusted heights of height adjustable surface 306. The sliding keyboard tray 350 can slide beneath height adjustable surface 306 when not in use.

In operation of some examples, sliding keyboard tray 350 can move with height adjustable surface 306 so that sliding keyboard tray 350 maintains a differential height relative to height adjustable surface 306. In operation of some examples, sliding keyboard tray 350 is slidable between a storage position and an extended position. In some examples, sliding keyboard tray 350 is slidable between a storage position and an extended position while height adjustable surface 306 is in either a raised or lowered position or any position in between. Sliding keyboard tray 350 can include a set of wheels and rails (not shown) to accommodate the sliding action of sliding keyboard tray 350 relative to height adjustable surface 306, in some example configurations.

In some examples, sliding keyboard tray 350 can be coupled to another portion of table 300 so that sliding keyboard tray 350 does not maintain a differential height relative to height adjustable surface 306.

As depicted in FIGS. 5-8 a "lower bar" or foot assembly can include an angled foot bracket. The horizontal portion of the foot bracket can be coupled to the edges of the recessed section of the table (or lower surface see FIG. 1), and the vertical portion of the foot bracket ("lower bar") can provide a mounting location for the 1 st and 2nd hinges of the first parallel linkage (1 st link) and the second parallel linkage (2nd link). In this configuration, the first and second parallel linkages of the first adjustment assembly (left linkage FIG. 8) can be rotatably mounted to the foot bracket through a hinge connection. Similarly, the first and second parallel linkages of the second adjustment assembly (right linkage FIG. 8) can be rotatably mounted to the foot bracket through a hinge connection.

Figure 5:
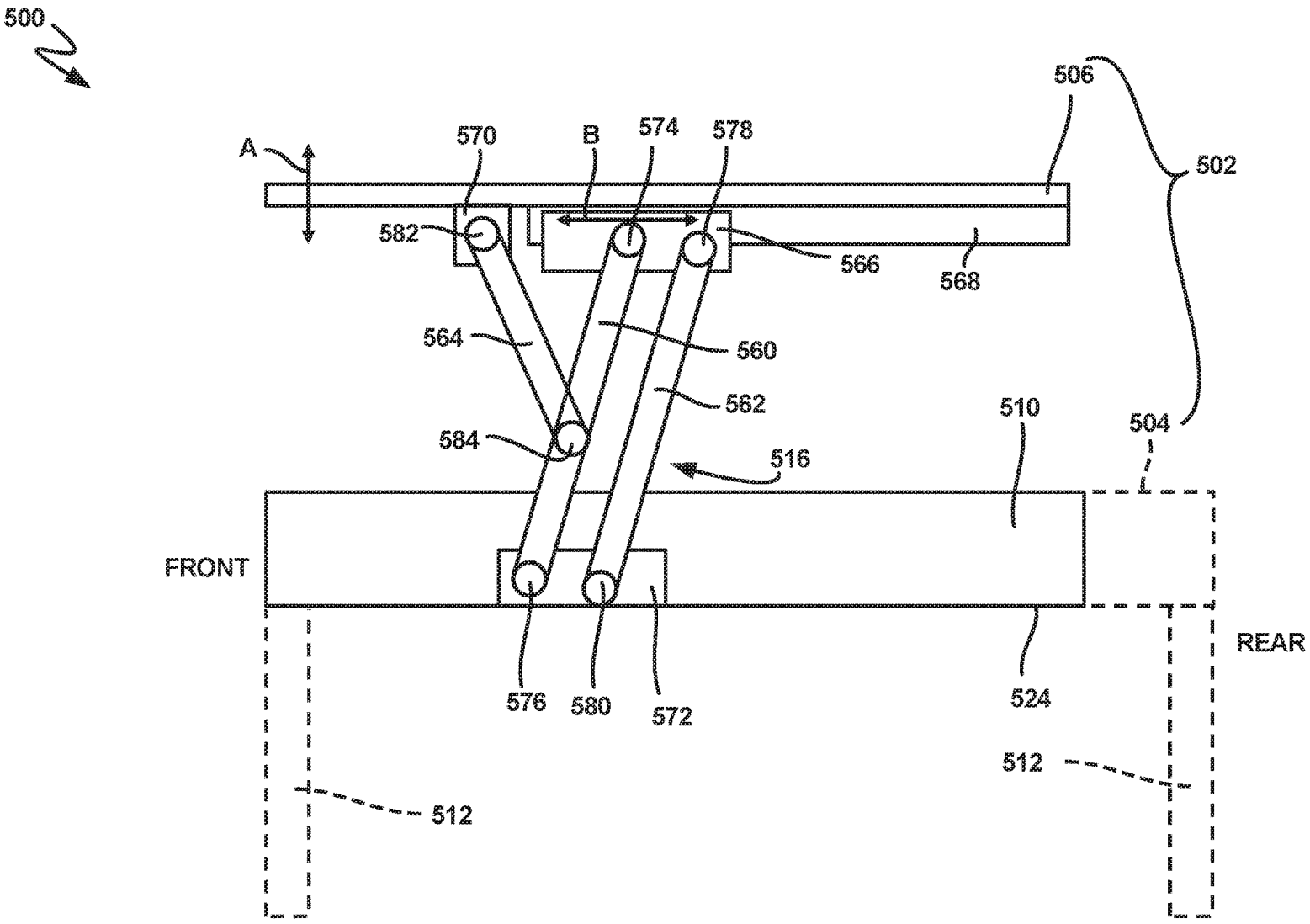
FIG. 5 illustrates a side view of the table with height adjustment mechanism in a raised position, in accordance with at least one example of this disclosure.
Figure 6A:
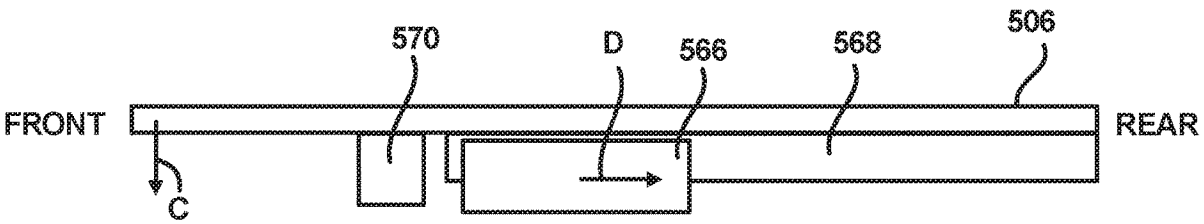
FIGS. 6A-6B illustrate a side view of the table with height adjustment mechanism in slightly lowered position, in accordance with at least one example of this disclosure.
Figure 6B:
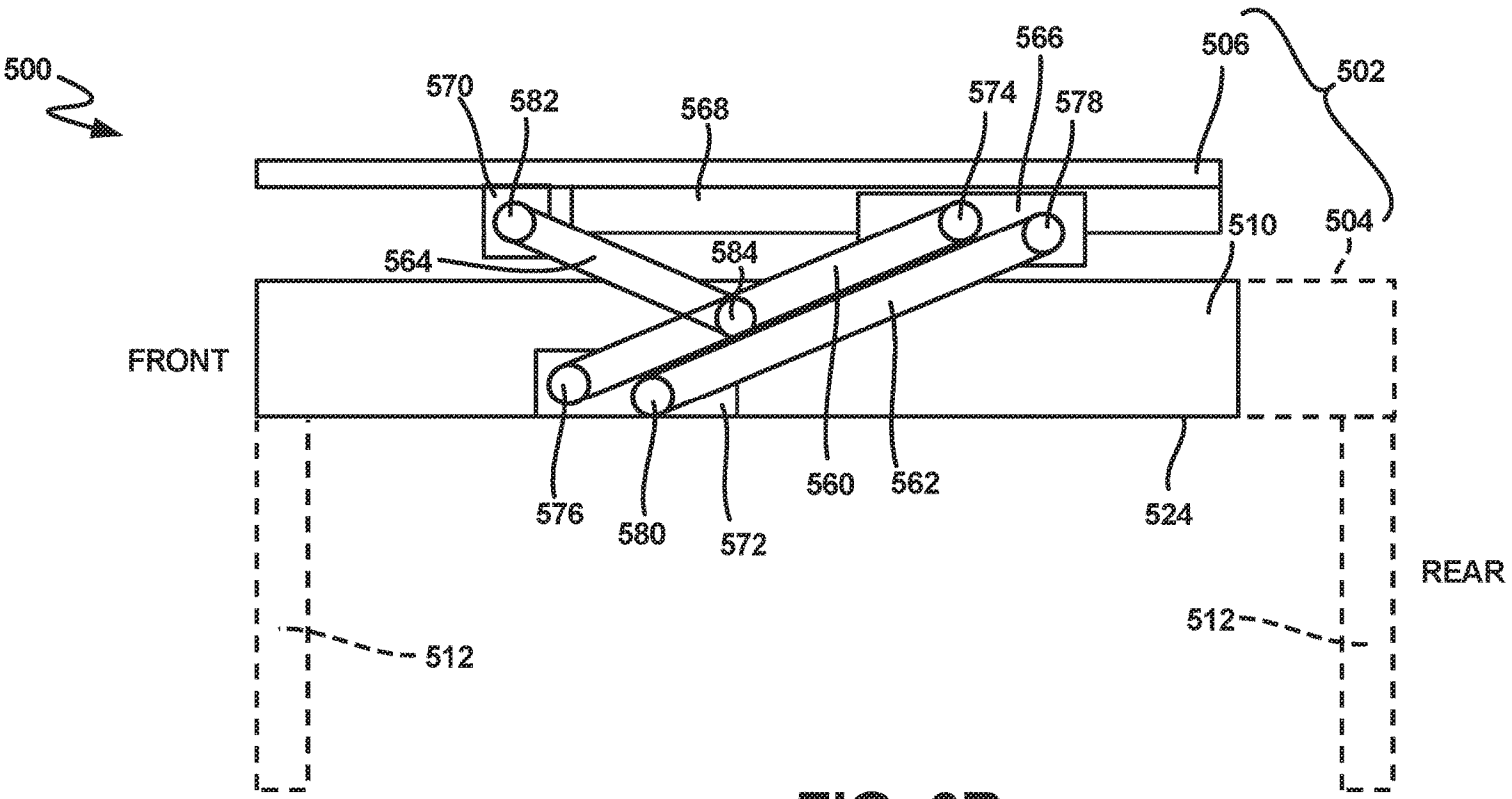
Figure 7:
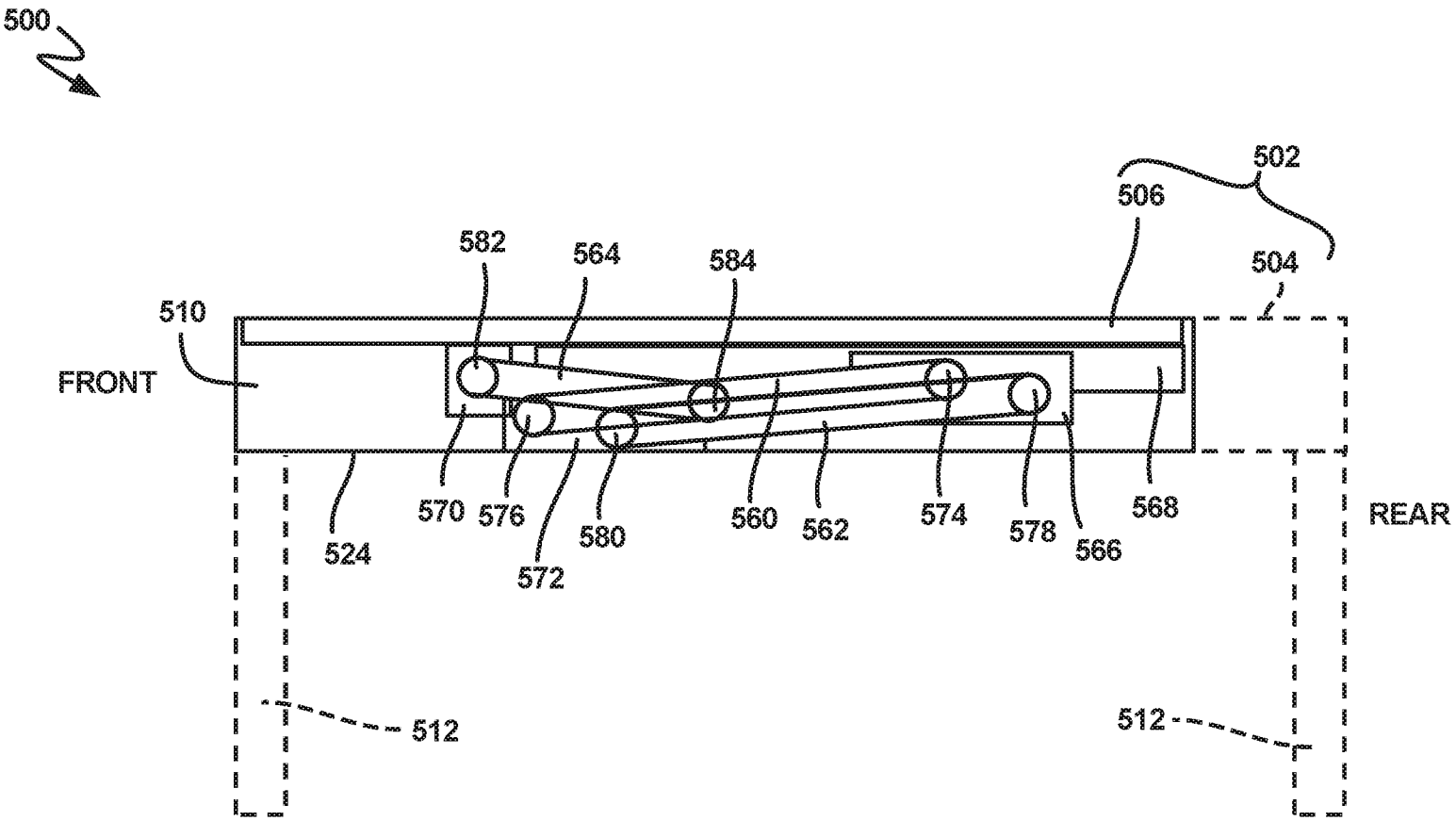
FIG. 7 illustrates a side view of the table with height adjustment mechanism in a lowered position, in accordance with at least one example of this disclosure.
Figure 8:
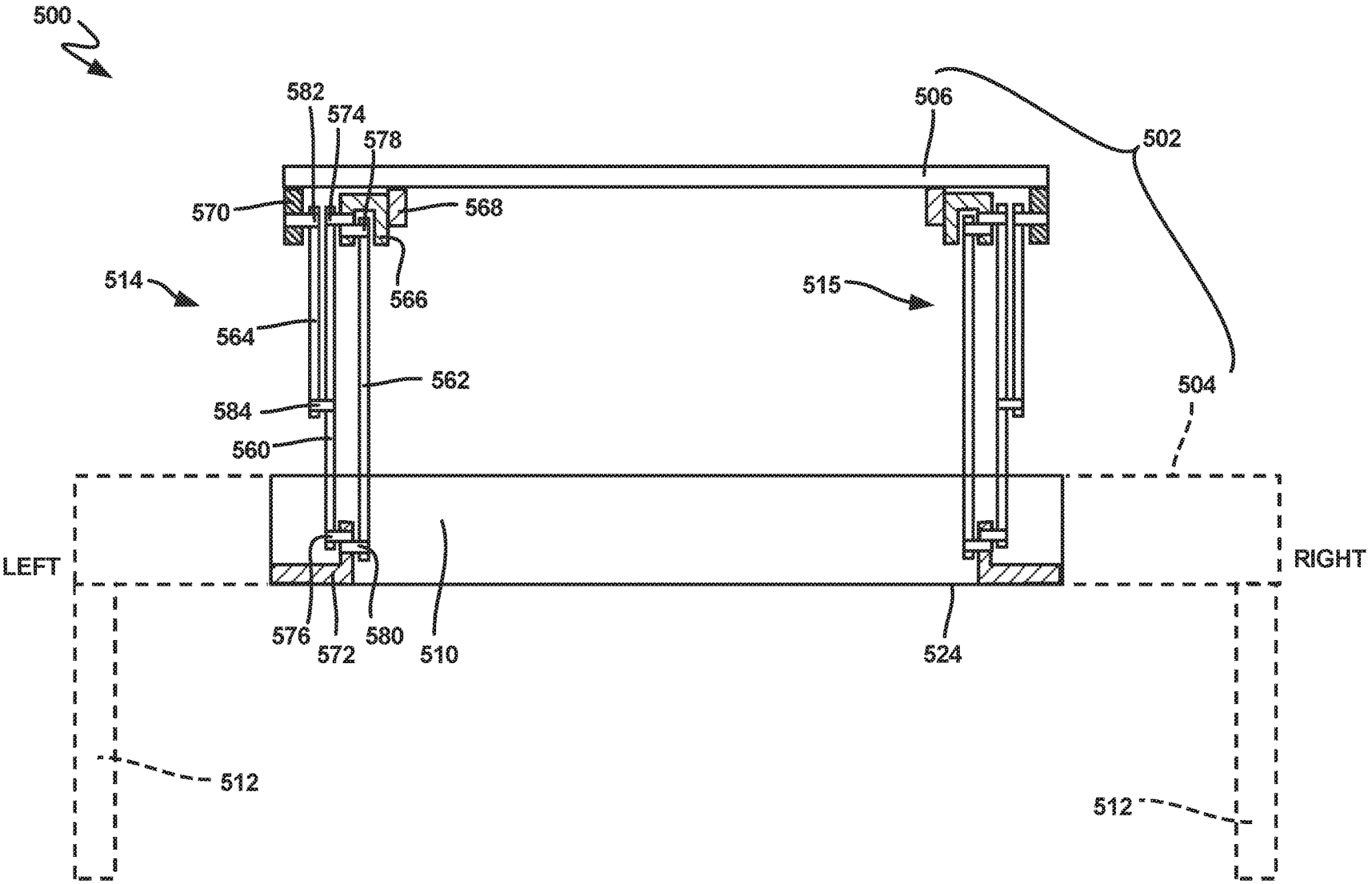
FIG. 8 illustrates a front view of the table with height adjustment mechanism in a raised position, in accordance with at least one example of this disclosure.

More specifically, FIGS. 5-8 illustrate table 500 in multiple positions. FIG. 5 illustrates a side elevation view of table 500 in a raised position, in accordance with at least one example of this disclosure. FIG. 6A illustrates a side elevation view of a top portion of table 500 showing how some components of table 500 move, in accordance with at least one example of this disclosure. FIG. 6B illustrates a side elevation view of table 500 in a position between a raised and lowered position, in accordance with at least one example of this disclosure. FIG. 6B illustrates the height adjustable worksurface as it approaches the lowered position, with the glider sliding on the glide support away from the support bracket and closer to the edge of the height adjustable worksurface. FIG. 7 illustrates a side elevation view of table 500 in a lowered position, in accordance with at least one example of this disclosure. FIG. 8 illustrates a front elevation view of table 500 in a raised position, in accordance with at least one example of this disclosure. FIGS. 5-8 are discussed below concurrently.

Table 500 can include worksurface 502 (which can include fixed surface 504 and height adjustable surface 506), recessed portion 510, legs 512, height adjustment mechanisms 514 and 515, and lower portion 524. Height adjustment mechanisms 514 and 515 can each include first link 560, second link 562, third link 564, gliding bar 566, glide support 568, upper bracket 570, lower bar 572, first hinge 574, second hinge 576, third hinge 578, fourth hinge 580, fifth hinge 582, and sixth hinge 584. Also shown in FIGS. 5-8 are directional arrows A, B, C, and D and orientation indicators: front, rear, left, and right.

In the example shown in FIGS. 5-8, height adjustment mechanisms 514 and 515 can be a four bar linkage that can include a sliding linkage to translate height adjustable surface 506 in the directions of arrow A while keeping height adjustable surface 506 in a plane generally parallel to fixed surface 504. Glide support 568, gliding bar 566, and lower bar 572 ("foot bracket") can be configured such that the upper and lower structures do not interfere with each other and the linkages and height adjustable surface 506 can be lowered completely into recessed portion 510.

In some example configurations, height adjustment mechanism 514 can include first link 560 and second link 562 that can be parallel links coupling height adjustable surface 506 to fixed surface 504 to create a four bar linkage that moves height adjustable surface 506. More specifically, first link 560 can be coupled to gliding bar 566 at first hinge 574 and can be coupled to lower bar 572 at second hinge 576. Similarly, second link 562 can be coupled to gliding bar 566 at third hinge 578 and can be coupled to lower bar 572 at fourth hinge 580.

In some example configurations, lower bar 572 can be coupled to lower portion 524 (as shown in FIG. 8). In some examples, lower bar 572 can be coupled to the underside of fixed surface 504 (not shown). Lower bar 572 can be, as shown in FIG. 8, for example, an angular bracket. In some examples, lower bar 572 can have other shapes.

Third link 564 can be a transverse link that can be coupled to first link 560 at sixth hinge 584 and can be coupled to upper bracket 570 at fifth hinge 582. Third link 564, in some examples, can have a length of about one half of the length of first link 560 and second link 562. Upper bracket 570 can be coupled to the underside of height adjustable surface 506, in some examples (as shown in FIGS. 5-8), and can be coupled to another part of height adjustable surface 506 or another component coupled thereto, in some examples.

Glider bar 566 can be located near the support bracket or height adjustable surface 506. Glide support 568 can be coupled to the underside of height adjustable surface 506, in some examples. In other examples, glide support 568 can be coupled to other portions of height adjustable surface 506 or to another component that is coupled to height adjustable surface 506. Gliding bar 566 can, in some example configurations, engage with glide support 568 such that gliding bar 566 can translate along glide support 568 in a low friction manner and in the directions of arrow B (as shown in FIGS. 5 and 6B).

As depicted in FIGS. 5-8, in operation, gliding bars 566 of the height adjustment assemblies 514 and 515 can each slide along their corresponding glide support 568 between a first position (FIG. 5) and a second position (FIG. 7) which can correspondingly move height adjustable surface 506 between an elevated position and a lowered position. In the first position (see FIG. 5), each gliding bar 566 can be positioned proximate to the corresponding upper bracket 570 along the corresponding glide support 568 such that height adjustable surface 506 is elevated. In the second position (see FIG. 7) each gliding bar 566 is distal to the corresponding upper bracket 570 along the corresponding glide support 568 such that height adjustable surface 506 is lowered. As height adjustable surface 506 moves from the elevated position to lowered position by means of the linkage assembly, parallel linkages (first and second link) 560 and 562 can maintain a horizontal orientation of height adjustable surface 506, and the transfer linkage (third link) 564 can maintain the vertical orientation of height adjustable surface 506.

In operation of some examples, height adjustable surface 506 can be in a raised position, as shown in FIG. 5. Height adjustment mechanism 514 can then be unlocked, in accordance with the examples described above, allowing height adjustable surface 506 to be lowered in the direction of arrow C by applying a force in the direction of arrow C (shown in FIG. 6A). As a force is applied in the direction of arrow C, third link 564 can transmit force to first link 560. The force can also be transmitted to first link 560 and second link 562 through gliding bar 566. These forces can cause third link 564 to rotate about fifth hinge 582, first link 560 to rotate about second hinge 576, and second link 562 to rotate about fourth hinge 580. First link 560 and second link 562 can also rotate about first hinge 574 and third hinge 578, respectively, but can also transfer rotational movement into linear translation of first hinge 574 and third hinge 578, as gliding bar 566 translates in the direction of arrow D, guided by glide support 568. The result is that height adjustable surface 506 can moves downward in the direction of arrow C, toward recessed portion 510.

In some examples, instead of applying a force in the direction of arrow C, counterbalance mechanism 120 (e.g., of FIG. 1) can transmit a torque to first link 560 and/or second link 562, which can lower height adjustable surface 506 in the direction of arrow C.

If the force is applied further, height adjustable surface 506 will continue to move downward in the direction of arrow C, further toward recessed portion 510 until height adjustable surface 506 reaches the lowered position, as shown in FIG. 7. When height adjustable surface 506 has lowered into the recessed portion 510, the upper surface of the height adjustable surface 506 can be on the same plane as the rest of the table surface. In this orientation, height adjustable surface 506 can be leveled with the rest of the top surface of table 500. Also, height adjustment mechanism 514 can be completely enclosed inside recessed portion 510.

The height of the lowered position can be controlled by height adjustable surface 506 physically contacting a portion of recessed portion 510, or another portion of table 500, such as a stop. In some examples, height of the lowered position can be controlled by one or more components of height adjustment mechanism 514 having a limited range of rotation or movement.

Similarly, height adjustable surface 506 can have a maximum height, limited by contact between components, creating a stop. In some examples, the maximum height of height adjustable surface 506 can be limited by one or more components of height adjustment mechanism 514 having a limited range of rotation or movement.

Also shown in FIG. 8 is height adjustment mechanism 515. Height adjustment mechanism 515 can be comprised of the same components as height adjustment mechanism 514. In some examples, height adjustment mechanism 515 being similar to height adjustment mechanism 514 offers the benefits of increasing the stability of height adjustable surface 506 and offers increased strength and redundancy. In other examples, height adjustment mechanism 515 can have a linkage setup or configuration that is different from height adjustment mechanism 514.

First hinge 574, second hinge 576, third hinge 578, fourth hinge 580, and fifth hinge 582, and sixth hinge 584 can be a simple hinges such as bushings or pins, for example. In some examples, first hinge 574, second hinge 576, third hinge 578, fourth hinge 580, fifth hinge 582, and sixth hinge 584 can each comprise multiple ball bearings and a connecting rod.

First link 560, second link 562, and third link 564 can be made from flat stock sized to operate in accordance with the disclosure herein, or can be of other shapes, such as cylindrical rods, tubular rods, and the like. First link 560, second link 562, and third link 564 can be can be optionally comprised of a fibrous material, a metal, a plastic, and the like.

Figure 9:
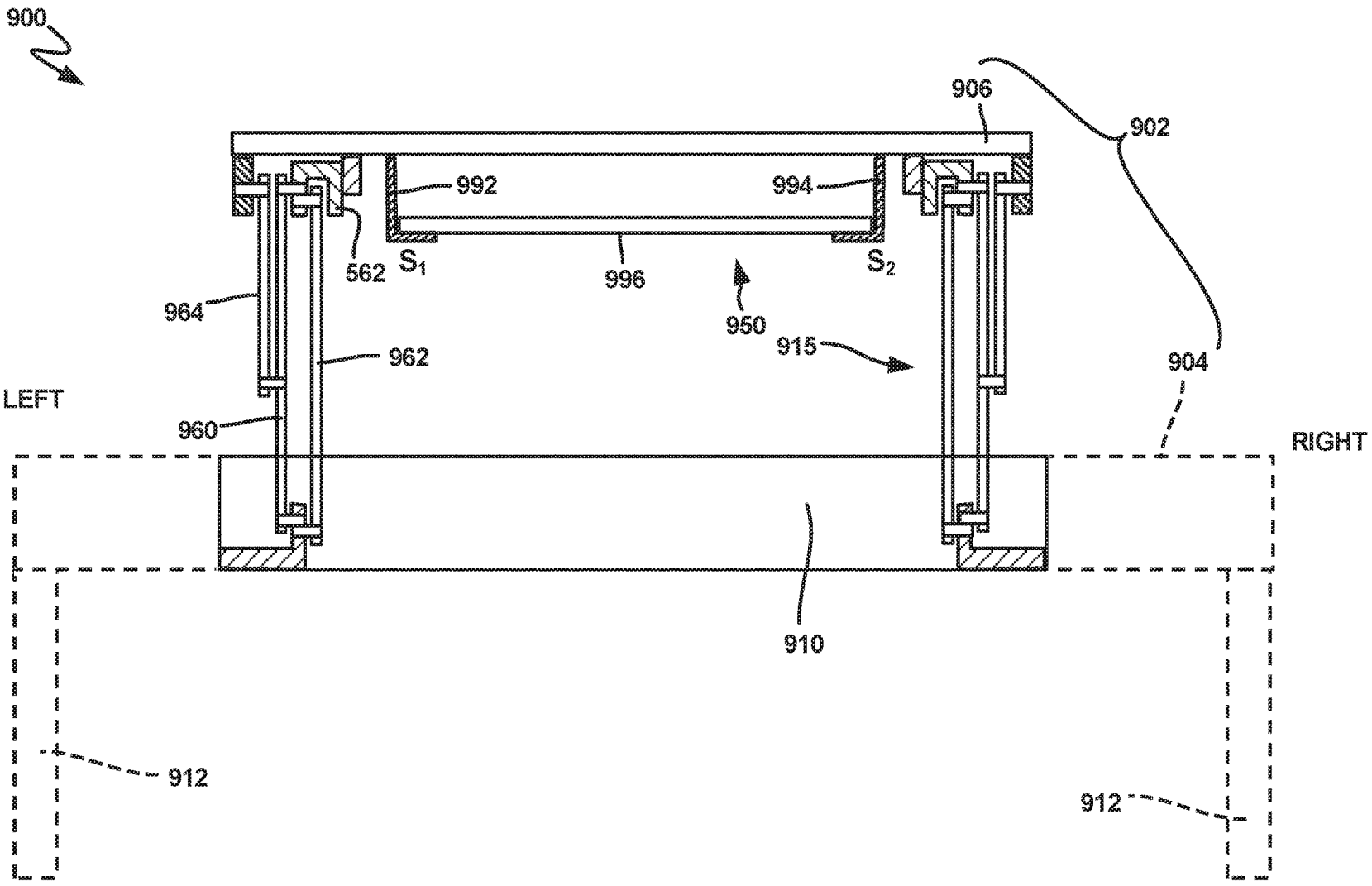
FIG. 9 illustrates a front view of the table with height adjustable worksurface having a suspended keyboard tray, in accordance with at least one example of this disclosure.
Figure 10:
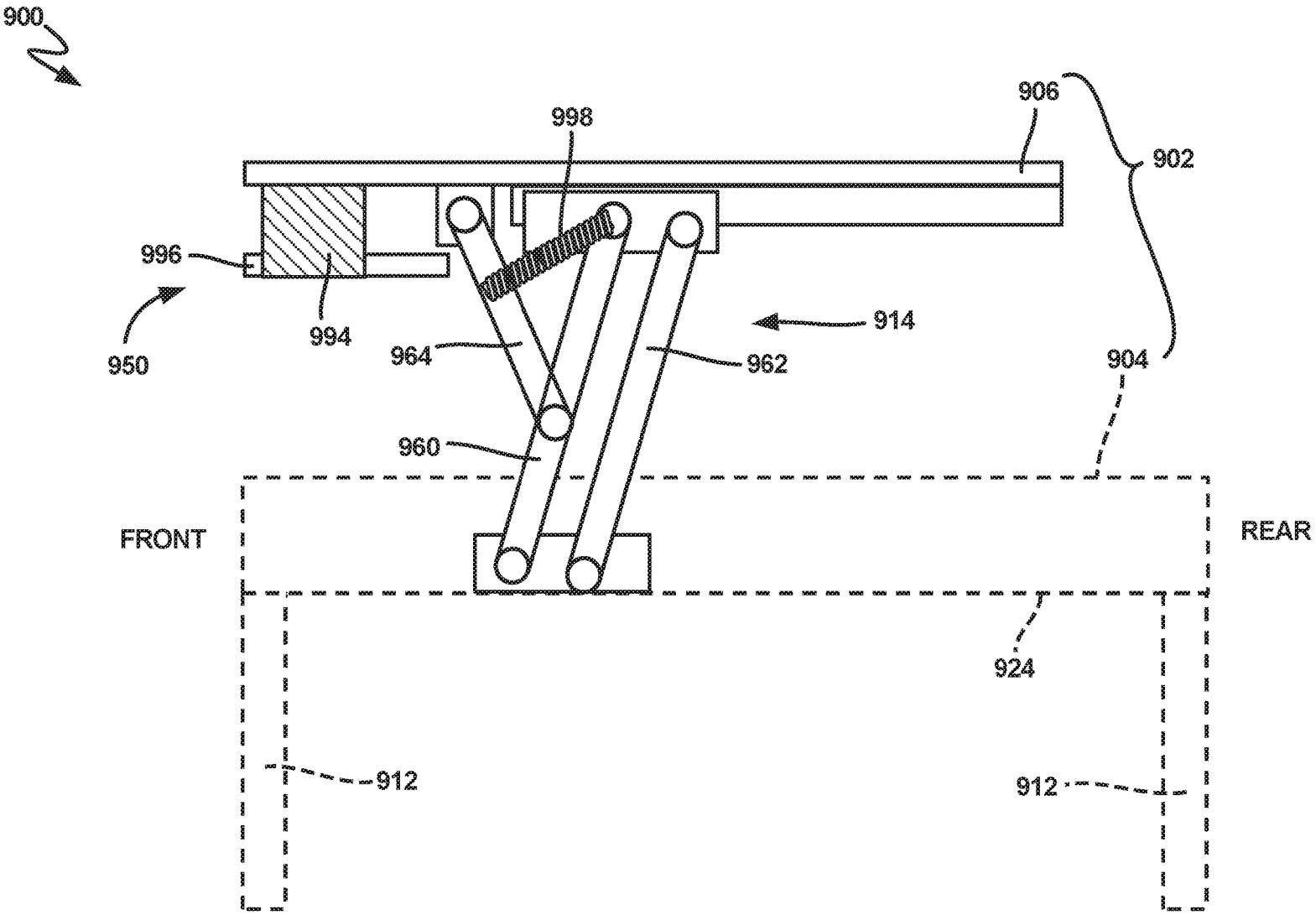
FIG. 10 illustrates a side view of the table with height adjustment mechanism in a raised position, in accordance with at least one example of this disclosure.
Figure 11:
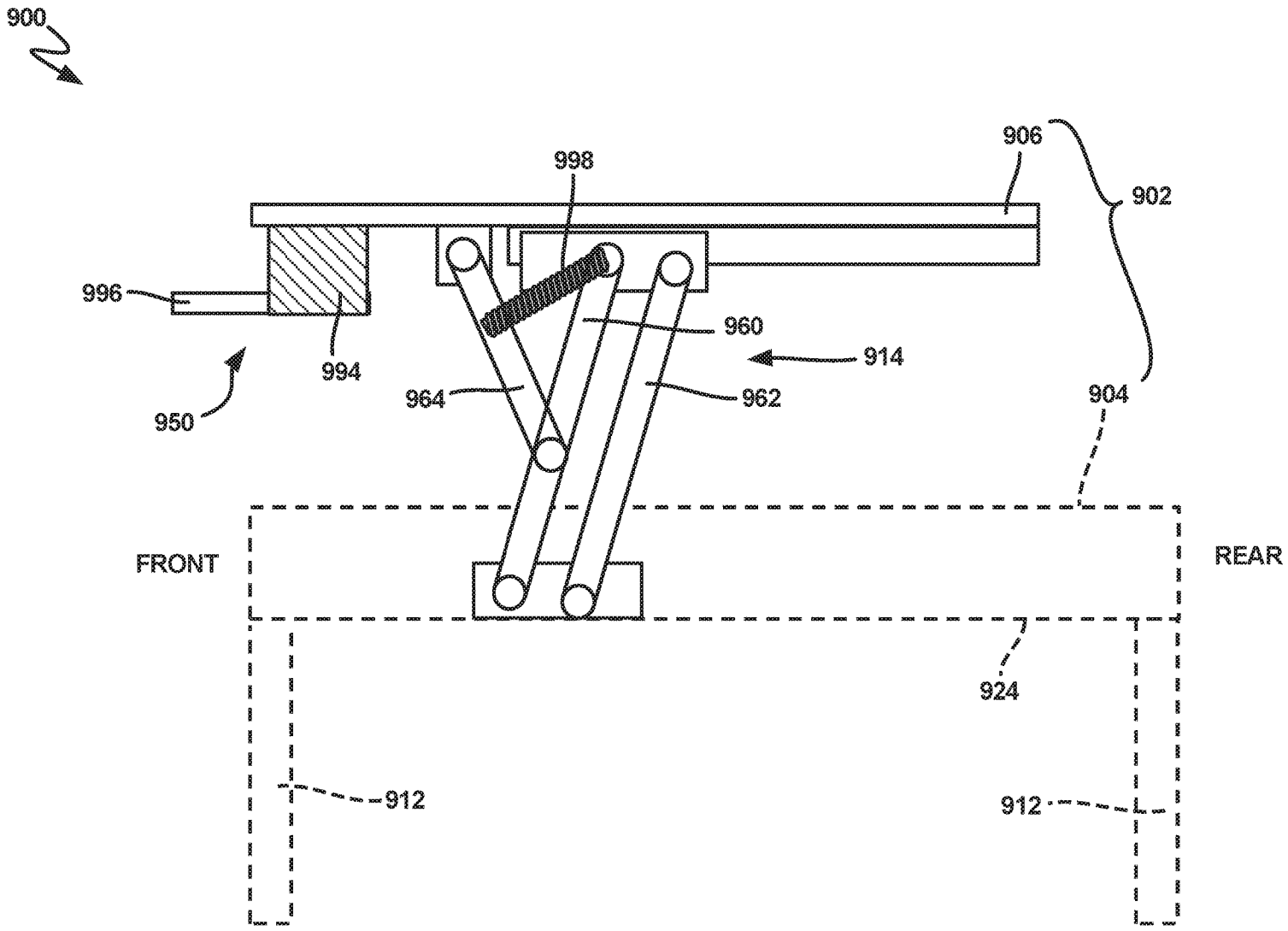
FIG. 11 illustrates a side view of the table with height adjustment mechanism in a raised position, in accordance with at least one example of this disclosure.
Figure 12A:
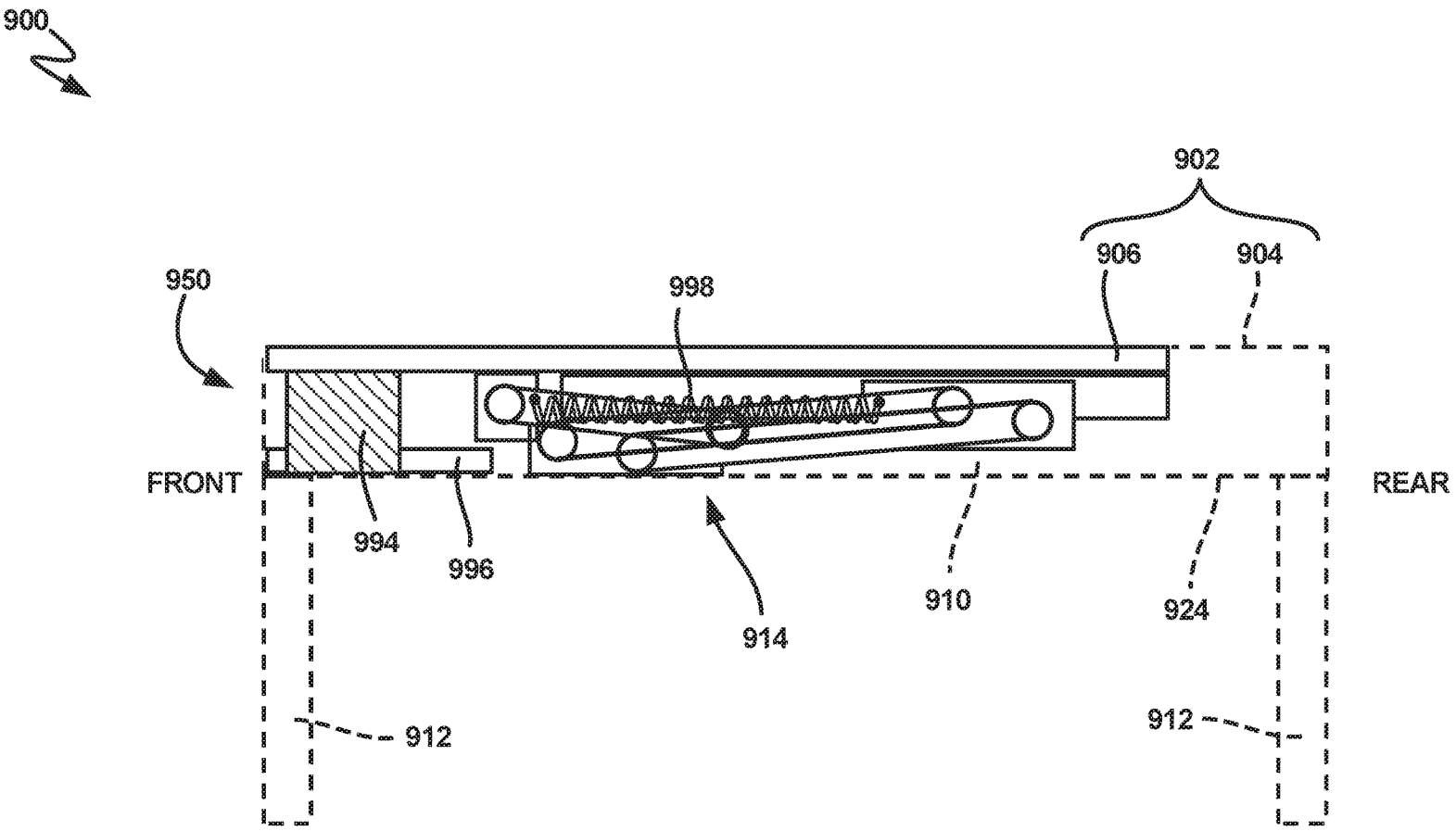
FIG. 12A illustrates a side view of the table with height adjustment mechanism in a lowered position, in accordance with at least one example of this disclosure.
Figure 12B:
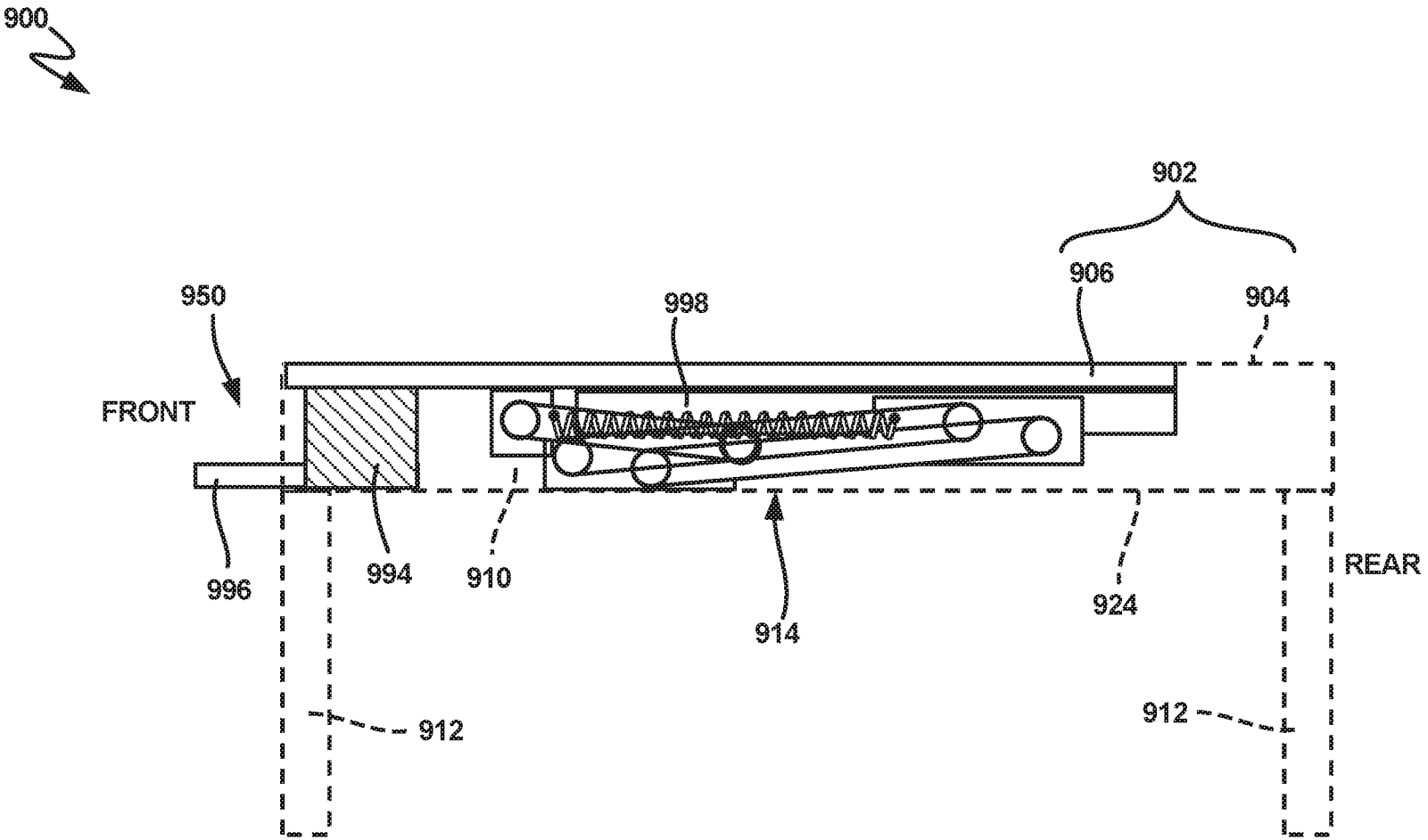
FIG. 12B illustrates a side view of the table with height adjustment mechanism in a lowered position, in accordance with at least one example of this disclosure.

FIGS. 9-12B illustrate table 900 in multiple perspectives and in multiple positions. FIG. 9 illustrates a front elevation view of table 900 in a raised position. FIG. 10 illustrates a side elevation view of table 900 in a raised position with sliding keyboard tray 950 in a retracted position. FIG. 11 illustrates a side elevation view of table 900 in a raised position with sliding keyboard tray 950 in an extended position. FIG. 12A illustrates a side elevation view of table 900 in a lowered position with sliding keyboard tray 950 in a retracted position. FIG. 12B illustrates a side elevation view of table 900 in a lowered position with sliding keyboard tray 950 in an extended position. In the example shown in FIGS. 9-12B, the components of table 900 can be connected and can operate consistently with the examples of the above disclosure. FIGS. 9-12B are discussed concurrently.

Table 900 can include worksurface 902 (which can include fixed surface 904 and height adjustable surface 906), recessed portion 910, legs 912, height adjustment mechanism 914, height adjustment mechanism 915, and sliding keyboard tray 950. Height adjustment mechanism 914 can include first link 960, second link 962, and third link 964. Sliding keyboard tray 950 can include tray 996, and support brackets 992 and 994. Height adjustment mechanism can also include spring 998.

The keyboard tray is illustrated in a retracted position such that an outer edge of the keyboard does not extend farther outward than the outer edge of the height adjustable worksurface.

Tray 996 of sliding keyboard tray 950 can be coupled to support brackets 992 and 994, which suspend tray 996 below height adjustable surface 906 such that there is no interference with the linkages of height adjustment mechanism 914. Support brackets 992 and 994 can be coupled to the underside of height adjustable surface 906, as in the examples shown. In some examples, support brackets 992 and 994 can be coupled to another component that is coupled to height adjustable surface 906 or height adjustment mechanism 914. Sliding keyboard tray 950 can be configured to support a keyboard and mouse, in some examples. In some examples, sliding keyboard tray 950 can be configured to support other items such that tray 996 can used as an additional working surface.

Because recessed portion 910 can include an opening in the front edge of the table (see FIG. 3), tray 996 can be extended in all raised and lowered positions of the height adjustable surface 906. In operation of some examples, sliding keyboard tray 950 can move with height adjustable surface 906 so that sliding keyboard tray 950 maintains a differential height relative to height adjustable surface 906. In operation of some example, sliding keyboard tray 950 is slidable between a storage position (or retracted position) and an extended position. In the storage position, sliding keyboard tray 950 does not extend beyond height adjustable surface 906. In the extended position, sliding keyboard tray 950 can extend beyond height adjustable surface 906 such that the surface of sliding keyboard tray 950 exposes a useful substantially planar surface.

Tray 996 can be retracted such that an outer edge of tray 996 does not extend further outward than the outer edge of height adjustable surface 906. Support brackets 992 and 994 can be configured such that height adjustable surface 906 can be lowered to the level of the table upper surface and height adjustment mechanism 914 can be configured to fit into recessed portion 910. The lowered position of height adjustable surface 906 can allow a user to work in a sitting position.

In some example configurations, sliding keyboard tray 950 can include one or more sets of wheels and rails (not shown) to accommodate the sliding action of sliding keyboard tray 950 relative to height adjustable surface 906. For example, tray 996 can include rails connected to tray 996 near sides S1 and S2 and support brackets 992 and 994 can each include a set of rails and wheels configured to receive the rails of tray 996 to enable sliding of tray 996 between the extended position and the storage position.

In some example configurations, tray 996 is slidable between a storage position and an extended position while height adjustable surface 906 is in either a raised or lowered position or any position in between, as shown in FIGS. 10-12B. For example, FIG. 10 shows height adjustable surface 906 in a raised position and tray 996 in a stored position. In operation of some examples, a user can extend tray 996 by sliding tray 996 toward the front of table 900, so that tray 996 is in the extended position, as shown in FIG. 11. When tray 996 is in the extended position, a user can slide tray 996 toward the rear of table 900 so that tray 996 is in the storage position, as shown in FIG. 10.

In some examples, FIG. 12A shows height adjustable surface 906 and a lowered position and tray 996 in a stored position. In operation of some examples, a user can extend tray 996 by sliding tray 996 toward the front of table 900, so that tray 996 is in the extended position, as shown in FIG. 12B. When tray 996 is in the extended position, a user can slide tray 996 toward the rear of table 900 so that tray 996 is in the storage position, as shown in FIG. 12A.

In some examples, tray 996 can be in the extended position while height adjustable surface 906 is in the raised position, as shown in FIG. 11. A user can then lower height adjustable surface 906, in accordance with the disclosure above, while tray 996 is extended. Tray 996 can remain extended while height adjustable surface 906 is lowered to the lowered position, as shown in FIG. 12B. Similarly, tray 996 can be in the extended position while height adjustable surface 906 is in the lowered position, as shown in FIG. 12B. A user can then raise height adjustable surface 906, in accordance with the disclosure above, while tray 996 is extended. Tray 996 can remain extended while height adjustable surface 906 is raised to the raised position, as shown in FIG. 11.

Also shown in FIGS. 10-12B is spring 998, which can be a compression or a tension spring. In some examples, spring 998 can be coupled to first link 960 and second link 962 to function as a type of counterbalance. In some examples, spring 998 can be coupled to other links, or other components of height adjustment mechanism 914.

In the example shown in FIGS. 10-12B spring 998 can stretch as height adjustable surface 906 moves between the raised and lowered positions. In at least one example where spring 998 is a tension spring, spring 998 can apply a force on height adjustment mechanism 914 to assist in raising height adjustable surface 906. In these examples, when height adjustable surface 906 is in the lowered position (shown in FIGS. 12A and 12B), spring 998 can be stretched and applying forces on first link 960 and third link 964, such that the force applied on first link 960 is towards third link 964 in the direction of the span of spring 998, and the force is applied on third link 964 towards first link 960 and in the direction of the span of spring 998. These forces can be applied by spring 998 to reduce a force required to move height adjustable surface 906 to a raised position. Also, when height adjustable surface 906 is in the raised position, spring 998 can resist being stretched and can apply forces to first link 960 and third link 964 when a force is applied to move height adjustable surface 906 to a lowered position. This can increase the force required to lower height adjustable surface 906, which can help prevent height adjustable surface 906 from lowering accidentally or too quickly.

In some examples, spring 998 can be a compression spring used to limit the range of motion of height adjustment mechanism 914 and therefore the movable range of height adjustable surface 906.

Figure 13:
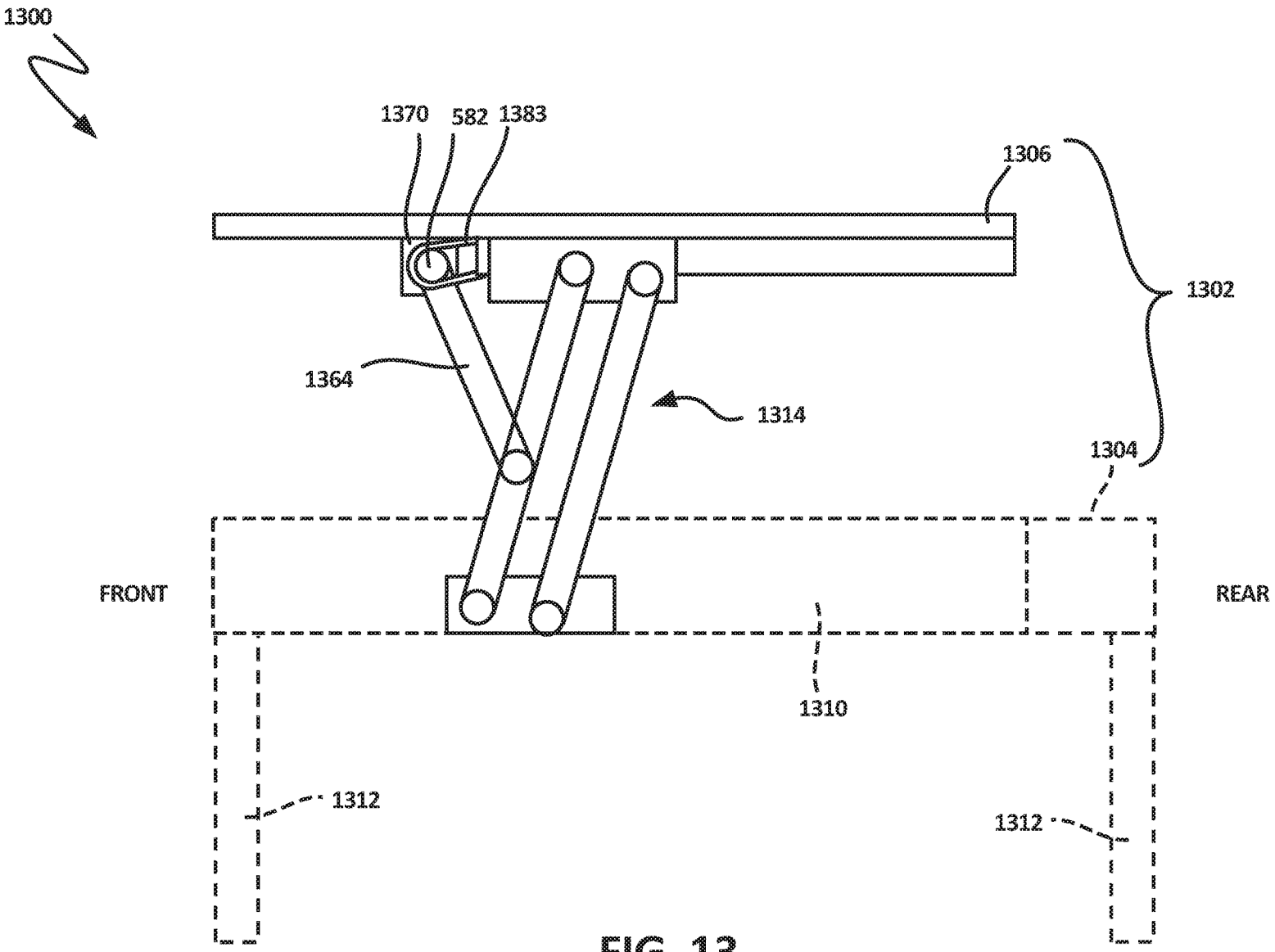
FIG. 13 illustrates a side view of the table w in a raised position, in accordance with at least one example of this disclosure.

FIG. 13 illustrates a side elevation view of table 1300 in a raised position consistent with at least one example of the present disclosure. Table 1300 can operate consistently with FIGS. 1-12 discussed above; however, table 1300 differs in that in can include torsion spring 1383. Torsion spring 1383, in some example configurations, can connect to third link 1364 at fifth hinge 582. In some examples, torsion spring 1383 can span between height adjustment mechanism 1314 and another height adjustment mechanism (such as height adjustment mechanism 515 shown in FIG. 8).

In operation of some examples, torsion spring 1383 can apply forces to height adjustment mechanism 1314. In other examples, torsion spring 1383 can apply forces to height adjustable surface 1306 or another portion of table 1300. The forces applied by torsion spring 1383 can resist or assist movement of height adjustable surface 1306 relative to fixed surface 1304, as described with respect to FIGS. 9-12B above.

Figure 14B:
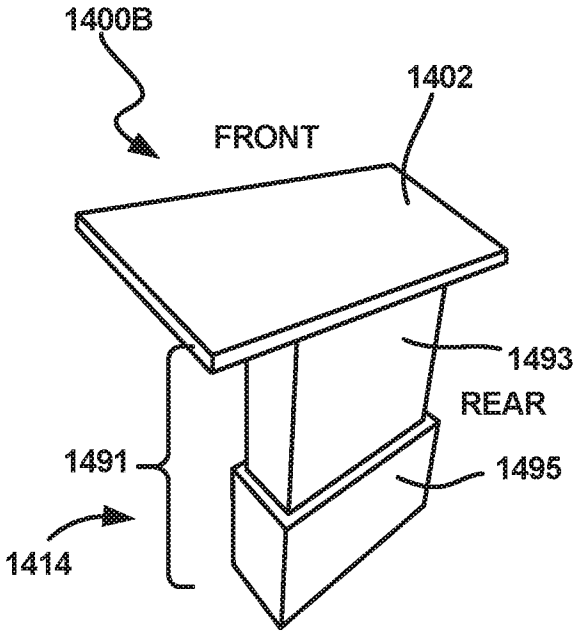
FIGS. 14A-14B illustrate perspective views of a height adjustable table with a telescoping riser, in accordance with at least one example of this disclosure.
Figure 14A:
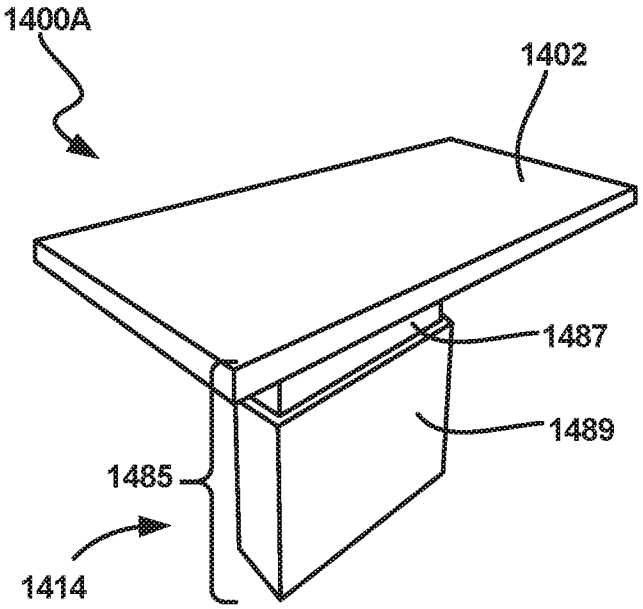

FIG. 14A illustrates an isometric view of table 1400A in accordance with at least one example of the present disclosure. Table 1400A can include worksurface 1402 and height adjustment mechanism 1414. Height adjustment mechanism 1414 can include telescopic riser 1485, which can include movable member 1487 and stationary member 1489.

In the example shown in FIG. 14A, height adjustment mechanism 1414 is approximately centered about worksurface 1402. Stationary member 1489 can include legs (as shown in previous examples), or a base (as shown in later examples), or can be fixed to another surface, such as a floor (in some examples). Stationary member 1489 can be of a tubular (or hollow) rectangular prism shape that is configured to have movable member 1487 nest within stationary member 1489. Accordingly, movable member 1487 can have an outer geometric shape that matches the inner geometric shape of stationary member 1489. In some examples, geometric shapes other than hollow rectangular prisms can be used for telescopic riser 1485, such as hollow cylinders or hollow trapezoidal prisms, and the like.

Movable member 1487 can be hollow, as shown in this example, but can be a solid member in some examples. Stationary member 1489 can include a linkage to move movable member 1487 and therefore worksurface 1402, as described in FIGS. 15-18 below. Movable member 1487 can be coupled to the underside of worksurface 1402, as shown in the example of FIG. 14A. Movable member 1487 can be coupled at another end to a linkage enclosed within stationary member 1489.

In some examples, movable member 1487 can include a linkage to move movable member 1487 relative to stationary member 1489 and therefore move worksurface 1402. Movable member 1487 can be coupled to the underside of worksurface 1402, as shown in the example of FIG. 14A, and the linkage within movable member 1487 can be coupled at another end to an end of stationary member 1489.

In operation of the example shown in FIG. 14A, a user can adjust the height of worksurface 1402 to a suitable height by extending and retracting movable member 1487 to move worksurface 1402 between a lowered and raised position, as described with regard to the examples above.

FIG. 14B illustrates an isometric view of table 1400B in accordance with at least one example of this disclosure. Table 1400B can include worksurface 1402 and height adjustment mechanism 1414. Height adjustment mechanism 1414 can include telescopic riser 1491, which can include movable member 1493 and stationary member 1495. FIG. 14B also shows orientation indicators, front and rear.

In the example shown in FIG. 14B, height adjustment mechanism 1414 is disposed near the rear of about worksurface 1402. Stationary member 1495 can include legs (as shown in previous examples), or a base (as shown in later examples), or can be fixed to another surface, such as a floor (in some examples). Stationary member 1495 can be of a tubular (or hollow) rectangular prism shape that is configured to nest within movable member 1493. Accordingly, movable member 1493 can have an inner geometric shape that matches the outer geometric shape of stationary member 1495. In some examples, geometric shapes other than hollow rectangular prisms can be used for telescopic riser 1491, such as hollow cylinders or hollow trapezoidal prisms, and the like.

Stationary member 1495 can be hollow in some examples, but can be a solid member in some examples. Stationary member 1495 can include a linkage to move movable member 1493 and therefore worksurface 1402, as described in FIGS. 15-18 below. Movable member 1493 can be coupled to the underside of worksurface 1402, as shown in the example of FIG. 14B. In some example configurations, a linkage within movable member 1493 can be coupled at one end to worksurface 1402 or movable member 1493 and at another end to the bottom of stationary member 1495 or to another member, such as a base, in some examples.

In operation of the example shown in FIG. 14B, a user can adjust the height of worksurface 1402 to a suitable height by extending and retracting movable member 1493 between a lowered and raised position, as described some examples below.

Figure 15:
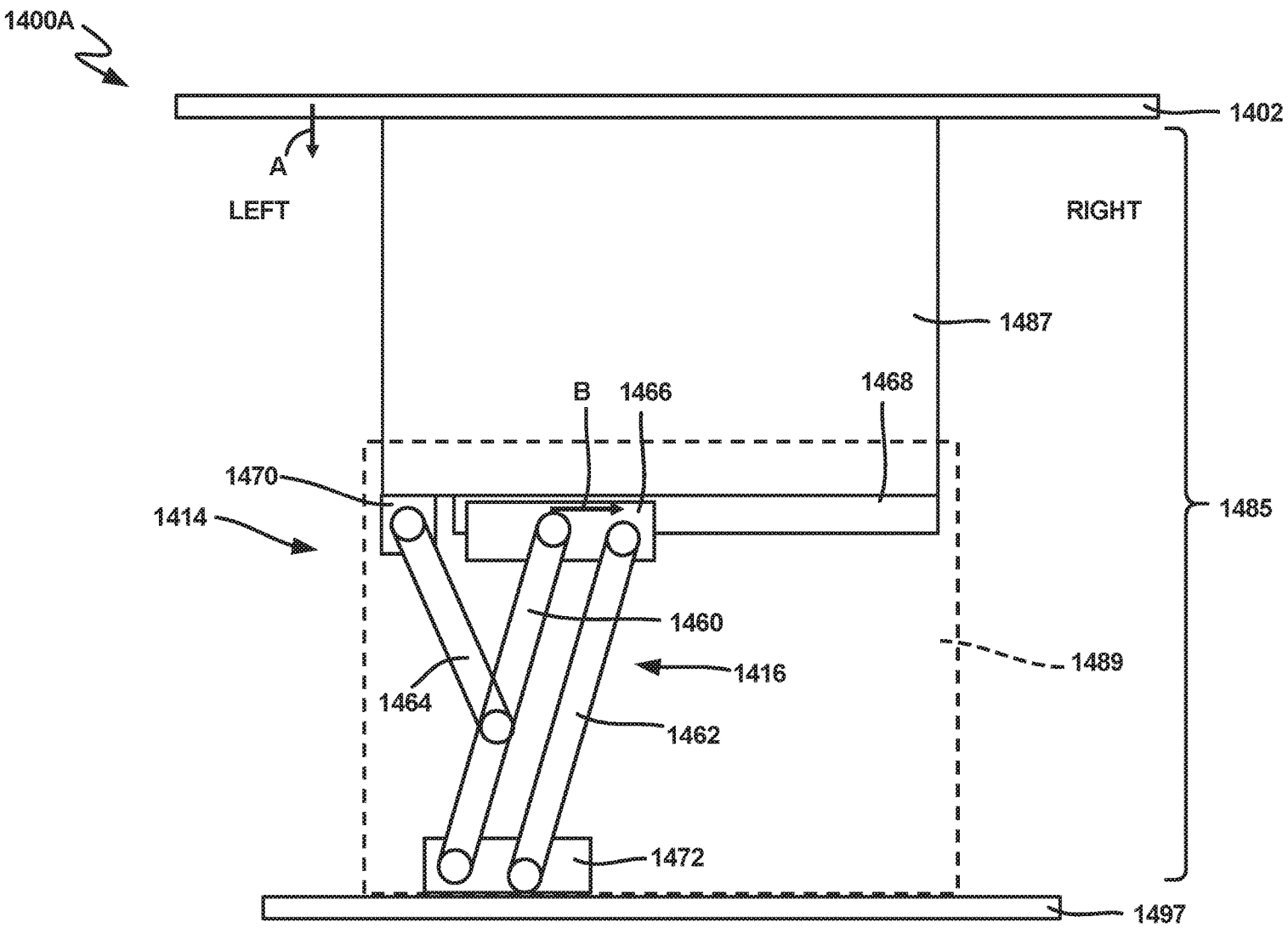
FIG. 15 illustrates a front view of the table with height adjustment mechanism in a raised position, in accordance with at least one example of this disclosure.
Figure 16:
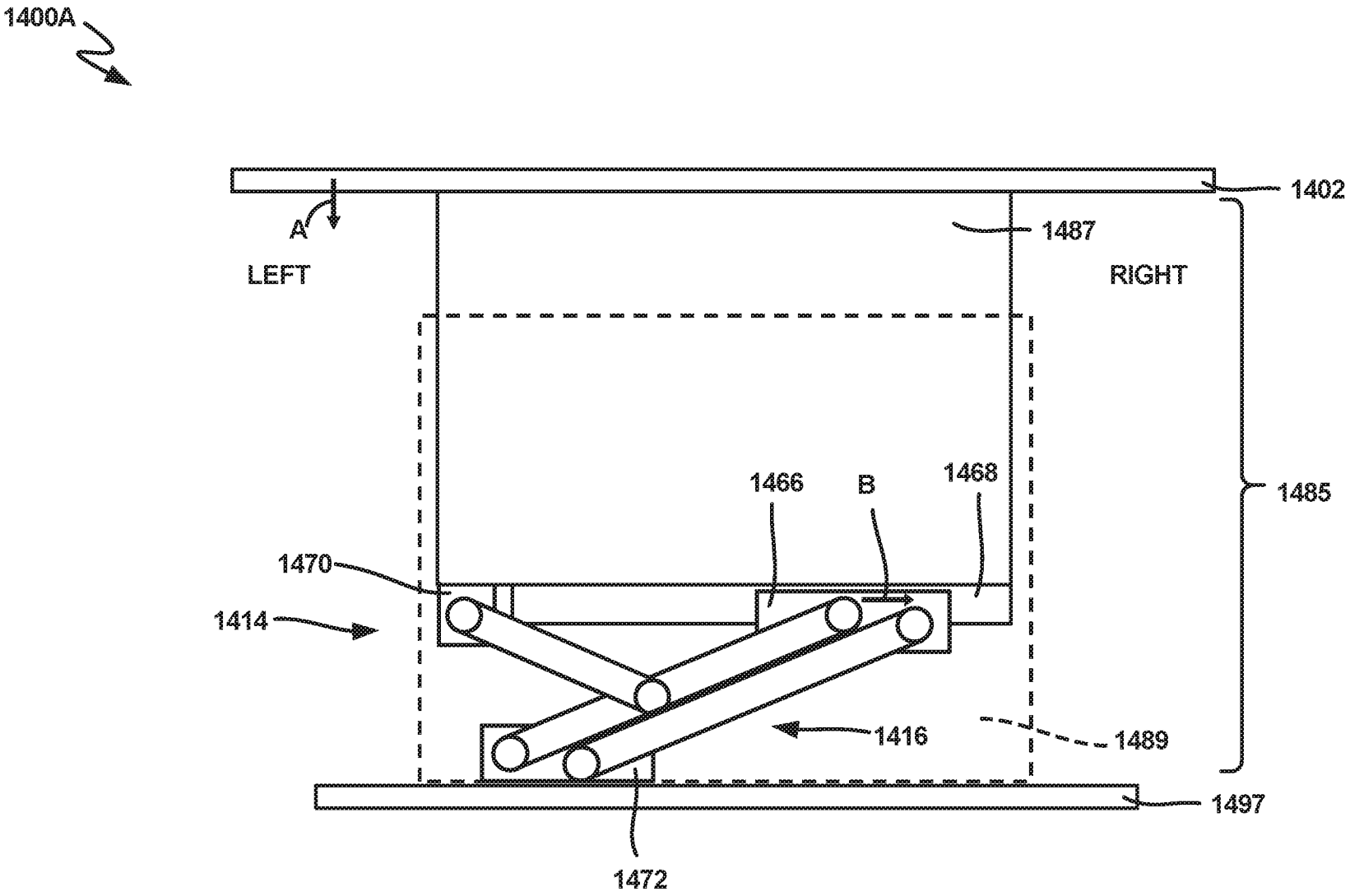
FIG. 16 illustrates a front view of the table with height adjustment mechanism between a raised and a lowered position, in accordance with at least one example of this disclosure.
Figure 17:
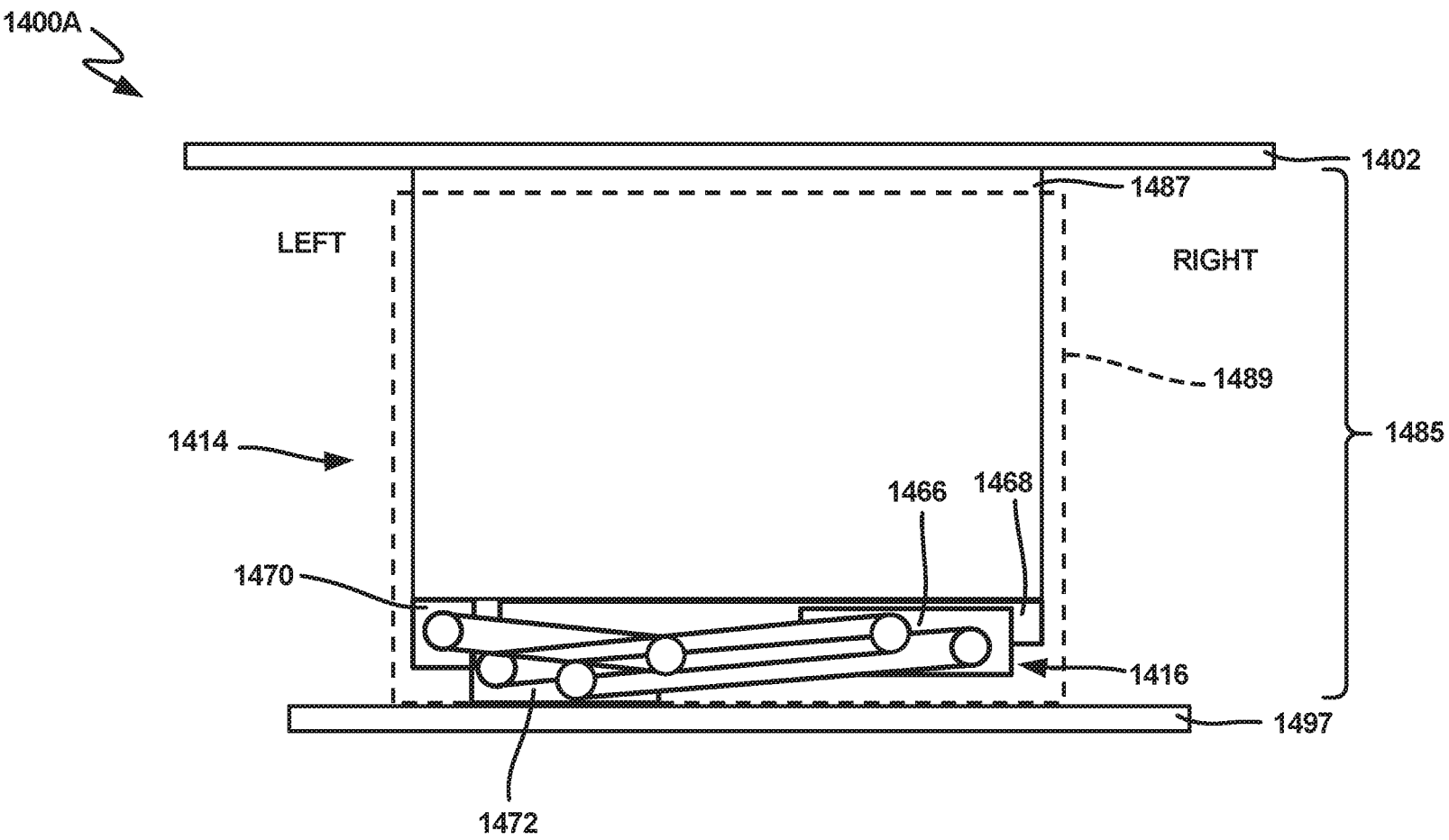
FIG. 17 illustrates a front view of the table with height adjustment mechanism in a lowered position, in accordance with at least one example of this disclosure.
Figure 18:
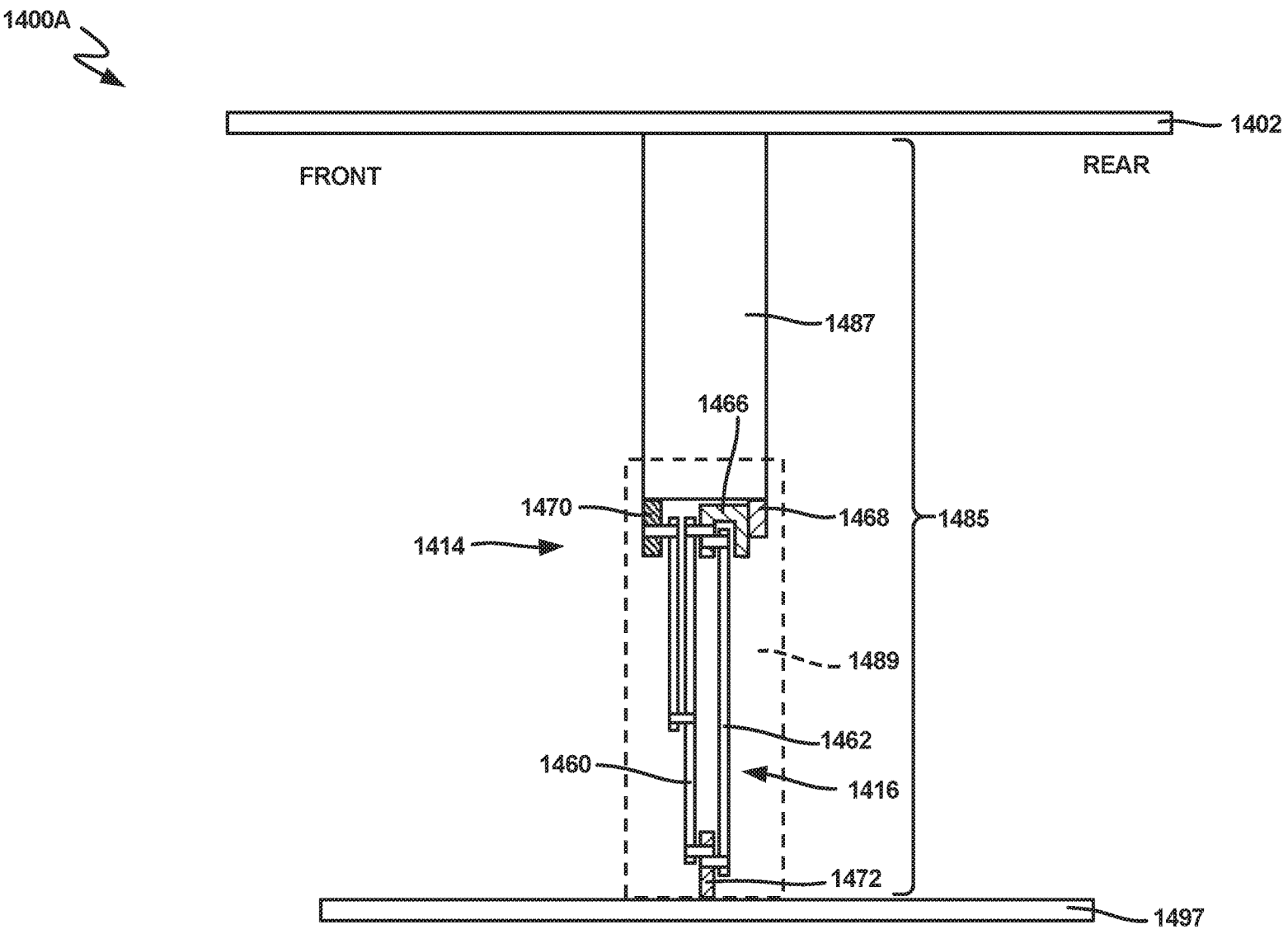
FIG. 18 illustrates a side view of the table with height adjustment mechanism in a raised position, in accordance with at least one example of this disclosure.

FIG. 15 illustrates a front elevation view of table 1400A of FIG. 14A in a raised position in accordance with at least one example of this disclosure. FIG. 16 illustrates a front elevation view of table 1400A between a raised and lowered position in accordance with at least one example of this disclosure. FIG. 17 illustrates a front elevation view of table 1400A in a lowered position in accordance with at least one example of this disclosure. FIG. 18 illustrates a side elevation view of table 1400A in a raised position in accordance with at least one example of this disclosure. FIGS. 15-18 are discussed concurrently.

Table 1400A can include worksurface 1402, height adjustment mechanism 1414, and base 1497. Height adjustment mechanism 1414 can include linkage 1416, and telescopic riser 1485, which can include movable member 1487 and stationary member 1489. Linkage 1416 can include first link 1460, second link 1462, third link 1464, gliding bar 1466, glide support 1468, upper bracket 1470, and lower bar 1472. Also shown in FIG. 15-18 are directional arrows A and B and orientation indicators: front, rear, left, and right. Table 1400A also can include hinges, and can include a counterbalance, such as a spring or motor, as described in the examples above.

In the example shown in FIGS. 15-18, linkage 1416 is disposed in stationary member 1489. In some examples, as previously explained, linkage 1416 can be disposed in movable member 1487. In the example shown in FIGS. 15-18, linkage 1416 is coupled to base 1497 and the underside of movable member 1487. More specifically, lower bar 1472 can be hingably coupled to first link 1460 and second link 1462. Lower bar 1472 can be secured to base 1497 in some examples, or to stationary member 1489 in some examples.

Linkage 1416 is coupled to the underside of movable member 1487 through glide support 1468 and upper bracket 1470. More specifically, first link 1460 can be hingably coupled to third link 1464, and third link 1464 can be hingably coupled to upper bracket 1470. Upper bracket 1470 can then be secured to the underside of movable member 1487, in some examples. In some examples, upper bracket 1470 can be secured to another component that is secured to movable member 1487. In some examples, upper bracket 1470 can be secured to another portion of movable member 1487.

First link 1460 and second link 1462 can also be coupled to gliding bar 1466, in some examples. In the same example, gliding bar 1466 can be coupled to glide support 1468, which can also be secured to the underside of movable member 1487, in some example configurations. In some examples configuration, glide support 1468 can be secured to another component that is secured to movable member 1487. In some examples, glide support 1468 can be secured to another portion of movable member 1487.

Linkage 1416 is a sliding four-bar linkage, in the example shown in FIGS. 15-18, and can operate consistently with the four-bar linkages described in the examples of the disclosure above. Linkage 1416 can differ in that, in some examples, linkage 1416 can drive movable member 1487 to extend from and retract into, in a telescopic manner, stationary member 1489.

In operation of some examples, table 1400A can be in a raised position (as shown in FIGS. 15 and 18) where linkage 1416 supports movable member 1487 in an extended position to maintain worksurface 1402 in a raised position. A user can then apply a force in the direction of arrow A to lower the height of worksurface 1402 to a suitable height, such as the height shown in FIG. 16, between a raised position and a lowered position. As described in the examples above, a force applied in direction A results in gliding bar 1466 to translate in direction B and results in the lowering of linkage 1416. In this example, when linkage 1416 lowers, linkage 1416 can lower movable member 1487 and worksurface 1402 attached thereto. During movement between raised and lowered positions, linkage 1416 maintains worksurface 1402 in a plane generally parallel to the plane of base 1497, in some examples. If a force is further applied in the direction of direction A, worksurface 1402 can be further lowered to the lowered position shown in FIG. 17. A locking system similar to those described in the examples above can be used to secure worksurface 1402 at a suitable height, in some examples.

The lowering process is reversible. For example, table 1400A can be in a lowered position (as shown in either FIG. 16 or 17). A user can then apply a force in a direction opposite to arrow A to raise the height of worksurface 1402 to a suitable height, such as the height shown in FIG. 16, between a raised height and a lowered height. If the force is further applied in a direction opposite to A, worksurface 1402 can be further raised to the raised position, as shown in FIGS. 15 and 18. In some example configurations, a counterbalance can be used to assist in adjusting the height of worksurface 1402. In some examples, a counterbalance can be used to apply all of the necessary force to adjust the height of workspace 1402.

Figure 19C:
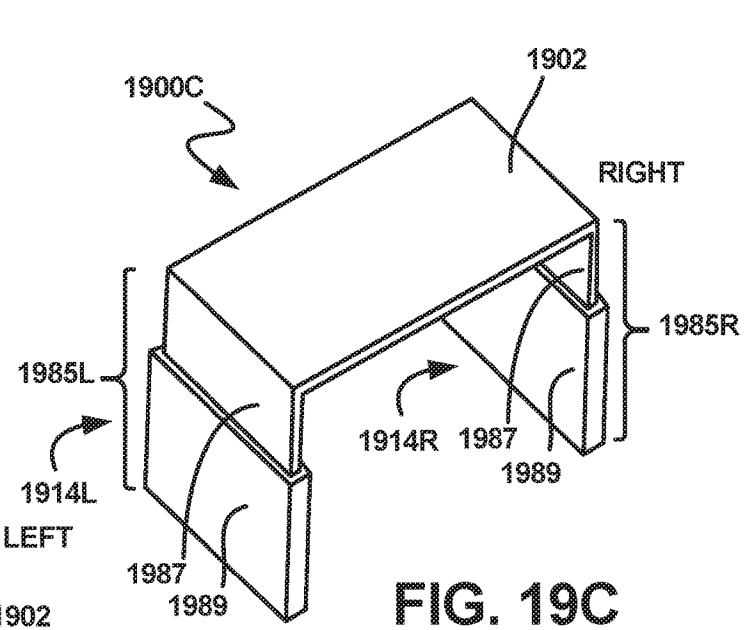
FIG. 19A-19C illustrate perspective views of different examples of height adjustable tables having dual telescoping risers, in accordance with at least one example of this disclosure.
Figure 19A:
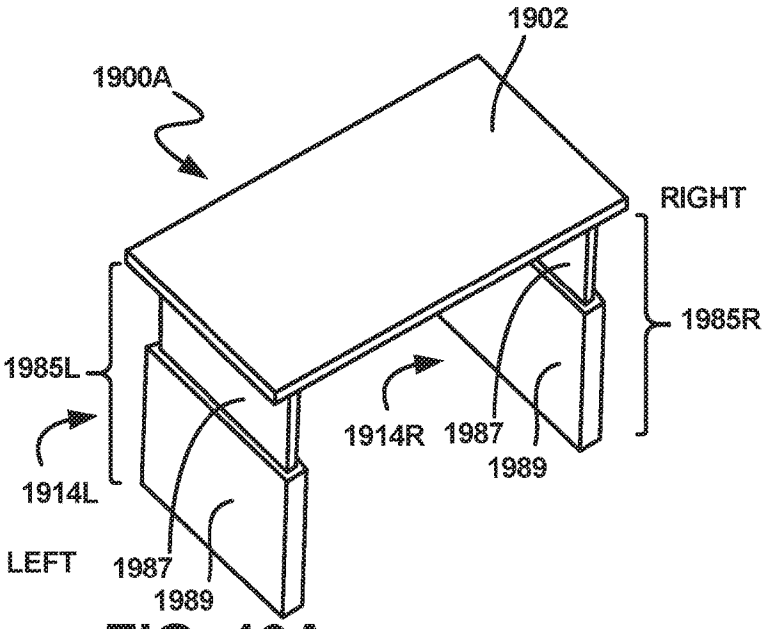

FIG. 19A illustrates a perspective view of table 1900A in accordance with at least one example of this disclosure. Table 1900A can include worksurface 1902, and height adjustment mechanism 1914L and 1914R. Each of height adjustment mechanisms 1914L and 1914R include telescopic member 1985, which can include movable member 1987 and stationary member 1989.

Height adjustment mechanisms 1914L and 1914R can be consistent with the height adjustment mechanisms of the examples described above. In the example shown in FIG. 19A, movable members 1987 can be coupled and secured to the underside of worksurface 1902. Movable member 1987 of height adjustment mechanism 1914L is coupled to the left underside of worksurface 1902 and movable member 1987 of height adjustment mechanism 1914R is coupled to the right underside of worksurface 1902. Stationary members 1989 can contact a surface, such as a floor, in some examples, or can be coupled to another surface, in some examples, to support table 1900A.

Movable members 1987 can be nestable within stationary members 1989. Also, each of movable members 1987 can be moved using a linkage, as described in FIG. 20.

Figure 19B:
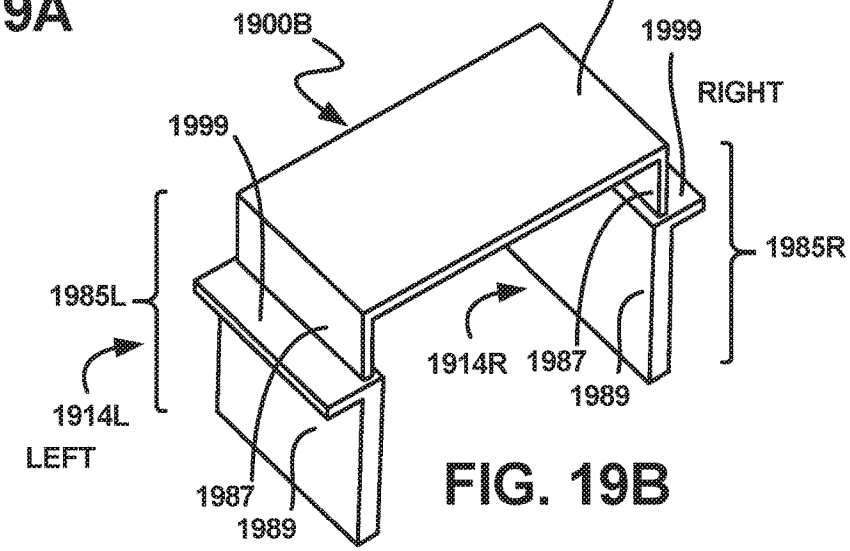

FIG. 19B illustrates a perspective view of table 1900B in accordance with at least one example of this disclosure. Table 1900B can include worksurface 1902 and height adjustment mechanisms 1914L and 1914R. Each of height adjustment mechanisms 1914L and 1914R include telescopic riser 1985, which can include movable member 1987 and stationary member 1989. Table 1900B also can include shelves 1999.

Shelves 1999 can be coupled to and cantilevered from the top of stationary members 1989, as shown in FIG. 19B. In some examples, not shown, shelves 1999 can be also supported by additional legs or members. Shelves 1999 can provide storage space for components that do not move with worksurface 1902, for example, a desktop computer.

FIG. 19C illustrates a perspective view of table 1900C in accordance with at least one example of this disclosure. Table 1900C can include worksurface 1902 and height adjustment mechanisms 1914L and 1914R. Each of height adjustment mechanisms 1914L and 1914R include telescopic riser 1985, which can include movable member 1987 and stationary member 1989.

In operation of the examples shown in FIGS. 19A-19C, a user can adjust the height of worksurface 1902 between raised and lowered positions in accordance with the disclosure above. The examples in FIGS. 19A-19C offer the additional benefit of incorporating the height adjustable mechanism into a structure (telescopic riser) that performs the function of traditional table legs, in some examples, to save space and reduce the number of components, while maintaining full function and redundancy.

Figure 20:
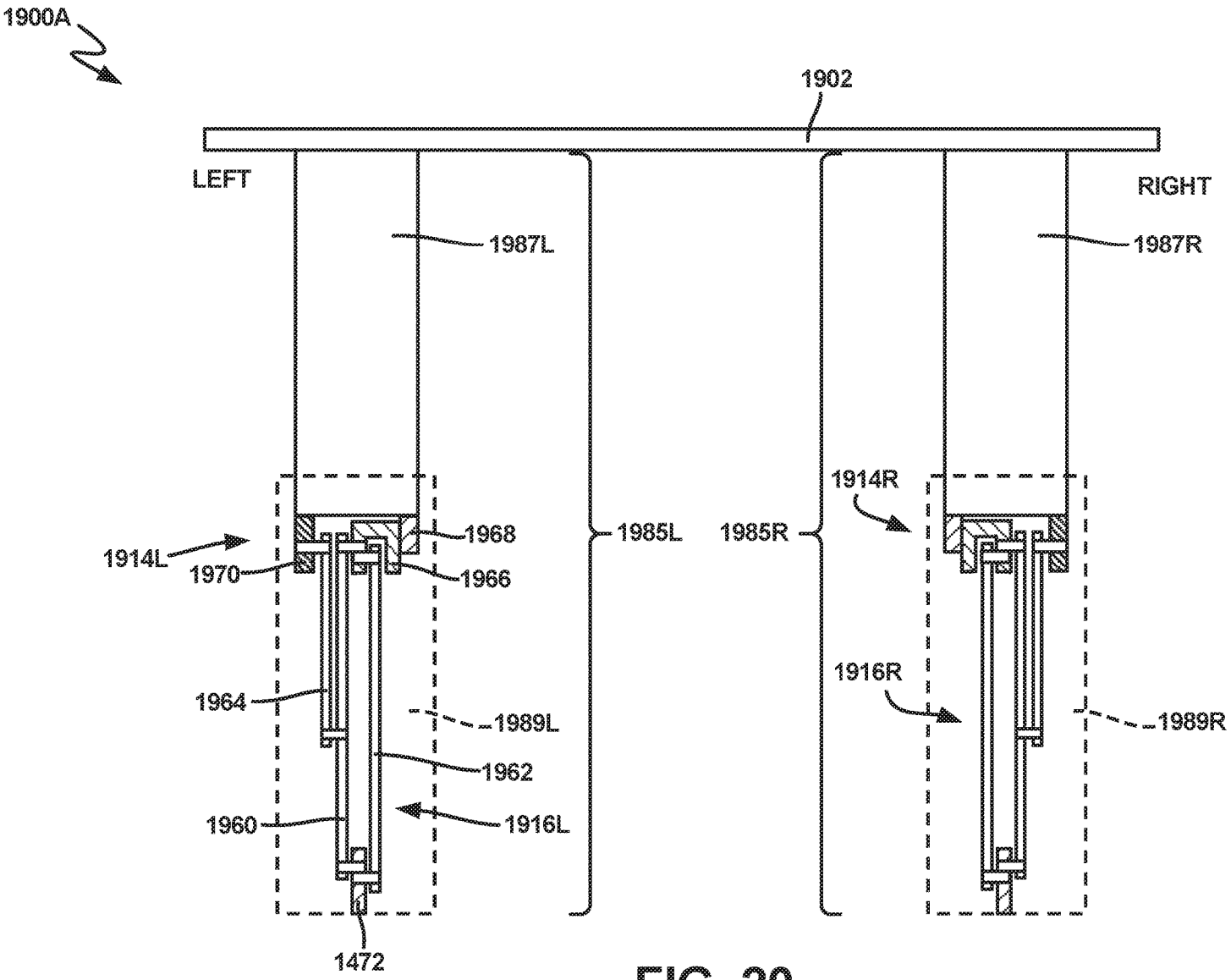
FIG. 20 illustrates a front view of the table with dual height adjustment mechanisms in a raised position, in accordance with at least one example of this disclosure.

FIG. 20 illustrates a front view of table 1900A of FIG. 19A in a raised position in accordance with at least one example of this disclosure. Table 1900A can include worksurface 1902 and height adjustment mechanisms 1914L and 1914R. Each of height adjustment mechanism 1914L and 1914R can include linkage 1916, movable member 1987 and stationary member 1989. Linkage 1916 can include first link 1960, second link 1962, third link 1964, gliding bar 1966, glide support 1968, upper bracket 1970, and lower bar 1972.

In the example shown in FIG. 20, each of lower bars 1972 can be coupled to stationary members 1989 and upper bracket 1970 and glide support 1968 can be coupled to movable members 1987. The dual risers or dual height adjustment mechanisms can be coupled as shown to leave a space between them for a user to sit at a height adjustable worksurface.

In operation of some examples, a force can be applied consistent with the explanations of previous examples above, to operate linkages 1916L and 1916R to adjust the height of worksurface 1902 between raised and lowered positions.

Each of these non-limiting examples can stand on its own, or can be combined in various permutations or combinations with one or more of the other examples.

Additional Notes and Examples

In Example 1, a height adjustable table can include subject matter (such as a device or apparatus) comprising: a plurality of legs; a lower portion coupled to and supported by the plurality of legs; a worksurface supported by the plurality of legs, the worksurface comprising: a fixed surface secured to at least one of the lower portion and the plurality of legs, the fixed surface defining a recessed portion; and a height adjustable surface coupled to at least one of the lower portion and the fixed surface, and movable between a raised position and a lowered position so that the height-adjustable surface retracts into the recessed portion when in the lowered position so that the height adjustable surface is coplanar with the fixed surface; a linkage configured to move the height adjustable surface between the lowered position and the raised position so that the height adjustable surface remains parallel to the fixed surface, the linkage comprising: an upper end coupled to the height adjustable surface; and a lower end coupled to at least one of the fixed surface and the lower portion.

In Example 2, the system of Example 1 can optionally be configured to further comprise a counterbalance mechanism coupled to the linkage that counteracts forces exerted on the height adjustable surface.

In Example 3, the system of any one or any combination of Examples 1-2 can optionally be configured such that the counterbalance mechanism comprises at least one of a tension spring, a compression spring, a torsion spring, an electric actuator, and a gas cylinder.

In Example 4, the system of any one or any combination of Examples 1-3 can optionally be configured such that the linkage further comprises: a glide coupled to the height adjustable surface and translatable between a first position and a second position such that the height adjustable surface is in the raised position when the glider is in the first position and is in the lowered position when the glider is in the second position; a first link rotatably coupled to the glider and to at least one of the fixed surface and the lower portion; and a transverse link rotatably coupled to the first link and to the height adjustable surface.

In Example 5, the system of any one or any combination of Examples 1-4 can optionally be configured such that the glider further comprises: a glide support coupled to the height adjustable surface; and a gliding bar rotatably coupled to the first link and slidable engaging the glide support.

In Example 6, the system of any one or any combination of Examples 1-5 can optionally be configured such that the linkage further comprises: a second link parallel to the first link and rotatably coupled to at least one of the fixed surface and the lower portion and rotatably coupled to the glider.

In Example 7, the system of any one or any combination of Examples 1-6 can optionally be configured to further comprise a second linkage disposed at a second side of the height adjustable surface and coupled to one of at least one of the fixed surface and the lower portion, the second linkage parallel to the linkage, wherein the linkage is disposed at a first side of the height adjustable surface; and a cross-member coupled to the linkage and coupled to the second linkage.

In Example 8, the system of any one or any combination of Examples 1-7 can optionally be configured to further comprise: a keyboard tray coupled to an underside of the height adjustable surface, and slidable between a storage position and an extended position.

In Example 9, the system of any one or any combination of Examples 1-8 can optionally be configured to further comprise: at least one of a side compartment and a rear compartment adjacent to the recessed portion and including a flip-up door comprised of a portion of the fixed surface.

In Example 10, the system of any one or any combination of Examples 1-9 can optionally be configured to further comprise a lever coupled to an underside of the height adjustable surface, the lever actuatable between a locked position and an unlocked position, the lever preventing the height adjustable surface from moving when the lever is in the locked position and allowing the height adjustable surface to move when the lever is in the unlocked position.

In Example 11, a height adjustable table can include subject matter (such as a device or apparatus) comprising: A height adjustable table comprising: a worksurface movable between a raised position and a lowered position; a base; a telescoping riser comprising: a stationary member coupled to the base; and a movable member coupled to the worksurface, nestable within the stationary member, and extendable from and retractable into the stationary member; and a linkage configured to move the height adjustable surface between the lowered position and the raised position so that the height adjustable surface remains parallel to the fixed surface, the linkage comprising: an upper end coupled to the height adjustable surface; and a lower end coupled to at least one of the fixed surface and the lower portion.

In Example 12, the system of Example 11 can optionally be configured such that the stationary member is centered about the base and the movable member is centered about the worksurface.

In Example 13, the system of Example 11 can optionally be configured such that the movable member is coupled to the worksurface near a periphery of the worksurface so that the worksurface cantilevers from the movable member.

In Example 14, the system of any one of Examples 11-13 can optionally be configured such that the linkage further comprises: a glider coupled to the height adjustable surface and translatable between a first position and a second position such that the height adjustable surface is in the raised position when the glider is in the first position and is in the lowered position when the glider is in the second position; a first link rotatably coupled to the glider and to at least one of the fixed surface and the lower portion; and a transverse link rotatably coupled to the first link and to the height adjustable surface.

In Example 15, the system of any one of Examples 11-14 can optionally be configured such that the glider further comprises: a glide support coupled to the height adjustable surface; and a gliding bar rotatably coupled to the first link and slidable engaging the glide support.

In Example 16, a height adjustable table can include subject matter (such as a device or apparatus) comprising: a worksurface movable between a raised position and a lowered position; a base spaced from the worksurface; a first telescoping riser comprising: a first stationary member coupled to the base near a first side of the base; a first movable member coupled to the worksurface near a first side of the worksurface, nestable within the first stationary member, and extendable from and retractable into the first stationary member; and a first linkage enclosed in the first stationary member and rotatably coupled to the first movable member and the base, the first linkage configured to extend and retract the first movable member; and a second telescoping riser comprising: a second stationary member coupled to the base near a second side of the base; a second movable member coupled to the worksurface near a second side of the worksurface, nestable within the second stationary member, and extendable from and retractable into the second stationary member; and a second linkage enclosed in the second stationary member and rotatably coupled to the second movable member and the base, the second linkage configured to extend and retract the second movable member.

In Example 17, the system of Example 16 can optionally be configured such that the each of the first and second linkages further comprise: a glider coupled to one of the first and second movable members and translatable between a first position and a second position such that the worksurface is in the raised position when the glider is in the first position and is in the lowered position when the glider is in the second position; a first link rotatably coupled to the base and to the glider; and a transverse link rotatably coupled to the first link and to one of the first and second movable members.

In Example 18, the system of any one or any combination of Examples 16-17 can optionally be configured such that each glider further comprises: a glide support coupled to one of the first and second movable members; and a gliding bar rotatably coupled to the first link and slidable engaging the glide support.

In Example 19, the system of any one or any combination of Examples 16-18 can optionally be configured such that each of the first and second linkages further comprise: a second link parallel to the first link and rotatably coupled to the base and to the glider.

In Example 20, the system of any one or any combination of Examples 16-19 can optionally be configured to further comprise a lever coupled to an underside of the worksurface, the lever being actuatable between a locked position and an unlocked position, wherein the lever prevents the worksurface from moving when the lever is in the locked position and allows the worksurface to move when the lever is in the unlocked position.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventor also contemplates examples in which only those elements shown or described are provided. Moreover, the present inventor also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of"at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment.

The invention claimed is:

1. A height adjustable workstation comprising:
- a worksurface movable between a raised position and a lowered position;
- a base;
- a telescoping riser coupled between the base and the worksurface, the telescoping riser comprising:
  - a first member; and
  - a second member slidably engaged with the first member to adjust a length of the telescoping riser between an extended configuration and a retracted configuration; and
- a linkage configured to move the worksurface between a lowered position and a raised position so that, the worksurface remains parallel to a support surface, the linkage comprising:
  - a first end rotatingly coupled to the second member;
  - a second end rotatingly coupled to the first member;
  - a glider coupled to the second member and translatable between a first position and a second position such that the worksurface is in the raised position when the glider is in the first position and is in the lowered position when the glider is in the second position;
  - a first link rotatably coupled to the glider and to the first member; and
  - a transverse link rotatably coupled to the first link and to the second member.

2. The height adjustable table of claim 1, wherein the first member is centered about the base and the second member is centered about the worksurface.

3. The height adjustable table of claim 1, wherein the second member is coupled to the worksurface near a periphery of the worksurface so that the worksurface cantilevers from the second member.

4. The height adjustable table of claim 1, wherein the glider further comprises:
- a glide support coupled to the worksurface; and
- a gliding bar rotatably coupled to the first link and slidable engaging the glide support.

5. The height adjustable table of claim 1, wherein the second member has a rectangular cross-section.

6. The height adjustable table of claim 1, wherein the second member is hollow.

7. The height adjustable table of claim 1, wherein the first member is coupled to the base.

8. The height adjustable table of claim 1, wherein the telescoping riser is a first telescoping riser and the linkage is a first linkage, the height adjustable workstation further comprising:
- a second telescoping riser and a second linkage.

9. A height adjustable workstation comprising:
- a worksurface movable between a raised position and a lowered position;
- a base;
- at least two telescoping risers coupled between the base and the worksurface, each of the telescoping risers comprising:
  - a first member; and
  - a second member slidably engaged with the first member to adjust a length of the telescoping riser between an extended configuration and a retracted configuration; and
- at least two linkages configured to move the worksurface between a lowered position and a raised position so that the worksurface remains parallel to a support surface, each of the linkages comprising:
  - a first end rotatingly coupled to the second member;
  - a second end rotatingly coupled to the first member;
  - a glider coupled to the second member and translatable between a first position and a second position such that the worksurface is in the raised position when the glider is in the first position and is in the lowered position when the glider is in the second position;
  - a first link rotatably coupled to the glider and to the first member; and
  - a transverse link rotatably coupled to the first link and to the second member.

10. The height adjustable table of claim 9, further comprising a shelf.

11. The height adjustable table of claim 10, wherein the shelf is coupled to the first member of at least one of the telescoping risers.

12. The height adjustable table of claim 11, wherein the shelf is cantilevered from adjacent a top end of the first member.

13. The height adjustable table of claim 9, wherein each of the telescoping risers are configured as a leg to support the worksurface.

14. The height adjustable table of claim 9, wherein the second member of each of the telescoping risers has a rectangular cross-section.

15. The height adjustable table of claim 14, wherein the second member of each of the telescoping risers is hollow.

* * * * *